US009618887B2

(12) United States Patent
Takagi et al.

(10) Patent No.: US 9,618,887 B2
(45) Date of Patent: Apr. 11, 2017

(54) FIXING DEVICE AND IMAGE FORMING APPARATUS

(71) Applicants: Hiromasa Takagi, Tokyo (JP); Kenji Ishii, Kanagawa (JP); Kazuhito Kishi, Kanagawa (JP); Takashi Seto, Kanagawa (JP); Takayuki Seki, Kanagawa (JP); Hiroshi Yoshinaga, Chiba (JP); Ippei Fujimoto, Kanagawa (JP); Kazunari Sawada, Tokyo (JP)

(72) Inventors: Hiromasa Takagi, Tokyo (JP); Kenji Ishii, Kanagawa (JP); Kazuhito Kishi, Kanagawa (JP); Takashi Seto, Kanagawa (JP); Takayuki Seki, Kanagawa (JP); Hiroshi Yoshinaga, Chiba (JP); Ippei Fujimoto, Kanagawa (JP); Kazunari Sawada, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 0 days.

(21) Appl. No.: 14/992,643

(22) Filed: Jan. 11, 2016

(65) Prior Publication Data

US 2016/0223961 A1 Aug. 4, 2016

(30) Foreign Application Priority Data

Jan. 30, 2015 (JP) ..... 2015-016726
Dec. 11, 2015 (JP) ..... 2015-242653

(51) Int. Cl.
*G03G 15/20* (2006.01)

(52) U.S. Cl.
CPC ..... *G03G 15/2053* (2013.01); *G03G 15/2042* (2013.01); *G03G 2215/2035* (2013.01)

(58) Field of Classification Search
CPC ..... G02G 15/2078; G02G 15/2082
See application file for complete search history.

(56) References Cited

U.S. PATENT DOCUMENTS 5,499,087 A * 3/1996 Hiraoka ..... G03G 15/2064 219/216
6,423,941 B1 * 7/2002 Kanari ..... G03G 15/2064 219/216

(Continued)

FOREIGN PATENT DOCUMENTS

JP 2007-240606 9/2007
JP 2009-271434 11/2009

(Continued)

*Primary Examiner* — Clayton E Laballe
*Assistant Examiner* — Victor Verbitsky
(74) *Attorney, Agent, or Firm* — Oblon, McClelland, Maier & Neustadt, L.L.P.

(57) ABSTRACT

A fixing device includes a flexible, tubular fixing rotator rotatable in a predetermined direction of rotation and an opposed rotator disposed opposite the fixing rotator. A nip formation pad presses against the opposed rotator via the fixing rotator to form a fixing nip between the fixing rotator and the opposed rotator, through which a recording medium bearing a toner image is conveyed. A fixing heater is disposed opposite at least a conveyance span of the fixing rotator in an axial direction thereof where the recording medium is conveyed to heat the fixing rotator. A lateral end heater is mounted on the nip formation pad and disposed opposite an inner circumferential surface of the fixing rotator at a lateral end of the fixing rotator in the axial direction thereof to heat the fixing rotator. A supplementary thermal conductor contacts the fixing rotator and the lateral end heater.

19 Claims, 14 Drawing Sheets

(56) References Cited

U.S. PATENT DOCUMENTS

| | | | | |
|---|---|---|---|---|
| 2011/0116848 | A1* | 5/2011 | Yamaguchi | G03G 15/2064 399/329 |
| 2011/0305474 | A1* | 12/2011 | Tanaka | G03G 15/2053 399/69 |
| 2013/0164059 | A1 | 6/2013 | Takagi et al. | |
| 2013/0170879 | A1 | 7/2013 | Yoshinaga et al. | |
| 2013/0183070 | A1 | 7/2013 | Kawata et al. | |
| 2013/0183071 | A1 | 7/2013 | Iwaya et al. | |
| 2013/0243465 | A1* | 9/2013 | Honda | G03G 15/2053 399/69 |
| 2014/0314459 | A1 | 10/2014 | Samei | |
| 2015/0063884 | A1 | 3/2015 | Iwaya et al. | |

FOREIGN PATENT DOCUMENTS

| | | |
|---|---|---|
| JP | 2014-115509 | 6/2014 |
| JP | 2014-178370 | 9/2014 |

* cited by examiner

FIXING DEVICE AND IMAGE FORMING APPARATUS

CROSS-REFERENCE TO RELATED APPLICATIONS

This patent application is based on and claims priority pursuant to 35 U.S.C. §119 to Japanese Patent Application Nos. 2015-016726, filed on Jan. 30, 2015, and 2015-242653, filed on Dec. 11, 2015, in the Japanese Patent Office, the entire disclosure of each of which is hereby incorporated by reference herein.

BACKGROUND

Technical Field

Exemplary aspects of the present disclosure relate to a fixing device and an image forming apparatus, and more particularly, to a fixing device for fixing a toner image on a recording medium and an image forming apparatus incorporating the fixing device.

Description of the Background

Related-art image forming apparatuses, such as copiers, facsimile machines, printers, or multifunction printers having two or more of copying, printing, scanning, facsimile, plotter, and other functions, typically form an image on a recording medium according to image data. Thus, for example, a charger uniformly charges a surface of a photoconductor; an optical writer emits a light beam onto the charged surface of the photoconductor to form an electrostatic latent image on the photoconductor according to the image data; a developing device supplies toner to the electrostatic latent image formed on the photoconductor to render the electrostatic latent image visible as a toner image; the toner image is directly transferred from the photoconductor onto a recording medium or is indirectly transferred from the photoconductor onto a recording medium via an intermediate transfer belt; finally, a fixing device applies heat and pressure to the recording medium bearing the toner image to fix the toner image on the recording medium, thus forming the image on the recording medium.

Such fixing device may include a fixing rotator, such as a fixing roller, a fixing belt, and a fixing film, heated by a heater and an opposed rotator, such as a pressure roller and a pressure belt, pressed against the fixing rotator to form a fixing nip therebetween through which a recording medium bearing a toner image is conveyed. As the recording medium bearing the toner image is conveyed through the fixing nip, the fixing rotator and the opposed rotator apply heat and pressure to the recording medium, melting and fixing the toner image on the recording medium.

SUMMARY

This specification describes below an improved fixing device. In one exemplary embodiment, the fixing device includes a flexible, tubular fixing rotator rotatable in a predetermined direction of rotation and an opposed rotator disposed opposite the fixing rotator. A nip formation pad presses against the opposed rotator via the fixing rotator to form a fixing nip between the fixing rotator and the opposed rotator, through which a recording medium bearing a toner image is conveyed. A fixing heater is disposed opposite at least a conveyance span of the fixing rotator in an axial direction thereof where the recording medium is conveyed to heat the fixing rotator. A lateral end heater is mounted on the nip formation pad and disposed opposite an inner circumferential surface of the fixing rotator at a lateral end of the fixing rotator in the axial direction thereof to heat the fixing rotator. A supplementary thermal conductor contacts the fixing rotator and the lateral end heater.

This specification further describes an improved image forming apparatus. In one exemplary embodiment, the image forming apparatus includes an image bearer to bear a toner image and a fixing device disposed downstream from the image bearer in a recording medium conveyance direction to fix the toner image on a recording medium. The fixing device includes a flexible, tubular fixing rotator rotatable in a predetermined direction of rotation and an opposed rotator disposed opposite the fixing rotator. A nip formation pad presses against the opposed rotator via the fixing rotator to form a fixing nip between the fixing rotator and the opposed rotator, through which the recording medium bearing the toner image is conveyed. A fixing heater is disposed opposite at least a conveyance span of the fixing rotator in an axial direction thereof where the recording medium is conveyed to heat the fixing rotator. A lateral end heater is mounted on the nip formation pad and disposed opposite an inner circumferential surface of the fixing rotator at a lateral end of the fixing rotator in the axial direction thereof to heat the fixing rotator. A supplementary thermal conductor contacts the fixing rotator and the lateral end heater.

BRIEF DESCRIPTION OF THE DRAWINGS

A more complete appreciation of the disclosure and the many attendant advantages thereof will be readily obtained as the same becomes better understood by reference to the following detailed description when considered in connection with the accompanying drawings, wherein.

DETAILED DESCRIPTION OF THE DISCLOSURE

Figure 1:
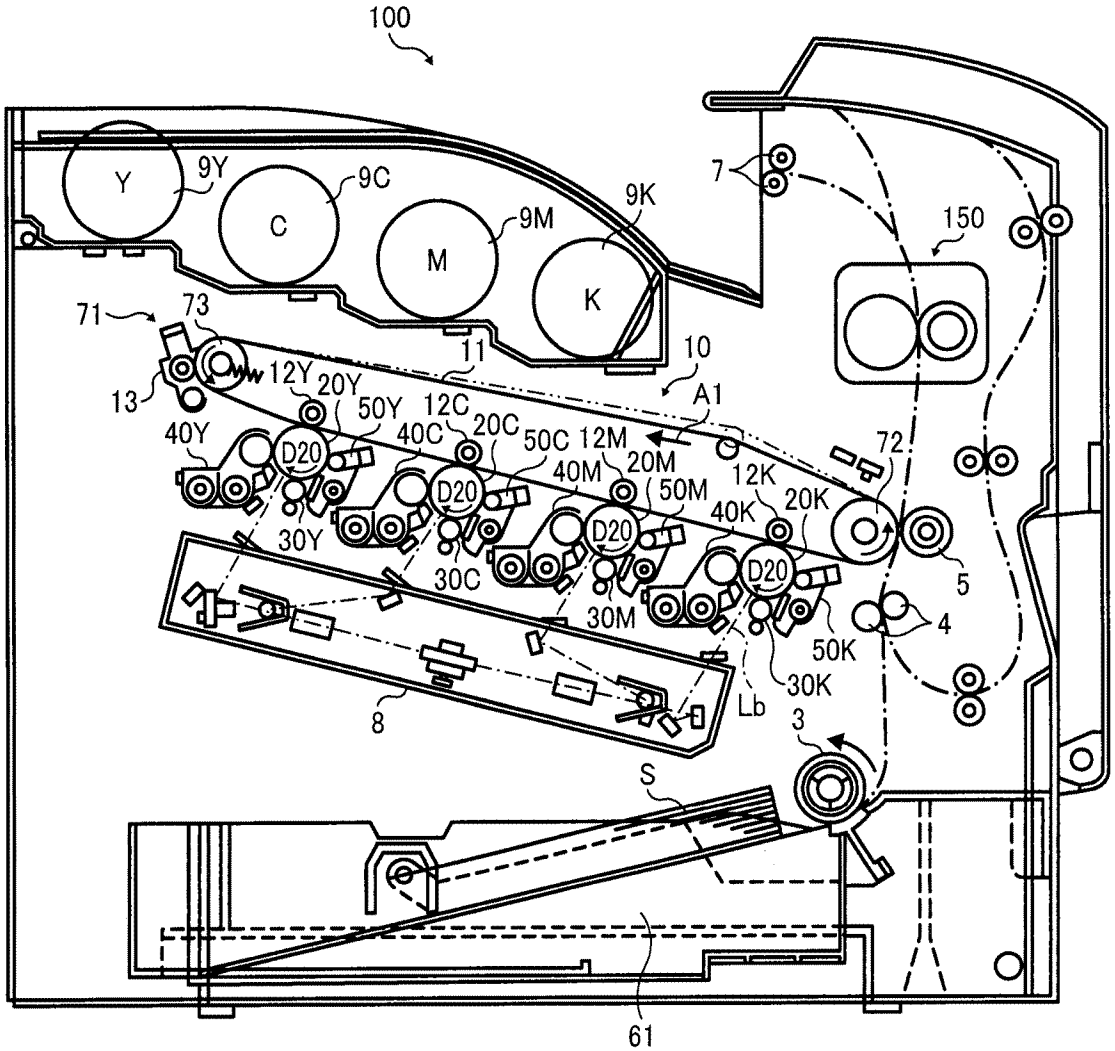
FIG. 1 is a schematic vertical sectional view of an image forming apparatus according to an exemplary embodiment of the present disclosure.

In describing exemplary embodiments illustrated in the drawings, specific terminology is employed for the sake of clarity. However, the disclosure of this specification is not intended to be limited to the specific terminology so selected and it is to be understood that each specific element includes all technical equivalents that operate in a similar manner and achieve a similar result.

Referring now to the drawings, wherein like reference numerals designate identical or corresponding parts throughout the several views, in particular to FIG. 1, an image forming apparatus 100 according to an exemplary embodiment of the present disclosure is explained.

It is to be noted that, in the drawings for explaining exemplary embodiments of this disclosure, identical reference numerals are assigned, as long as discrimination is possible, to components such as members and component parts having an identical function or shape, thus omitting description thereof once it is provided.

FIG. 1 is a schematic vertical sectional view of the image forming apparatus 100. The image forming apparatus 100 may be a copier, a facsimile machine, a printer, a multifunction peripheral or a multifunction printer (MFP) having at least one of copying, printing, scanning, facsimile, and plotter functions, or the like. According to this exemplary embodiment, the image forming apparatus 100 is a color printer that forms color and monochrome toner images on a recording medium by electrophotography. Alternatively, the image forming apparatus 100 may be a monochrome printer that forms a monochrome toner image on a recording medium.

A description is provided of a construction and an operation of the image forming apparatus 100.

The image forming apparatus 100 is a color printer employing a tandem system in which a plurality of image forming devices for forming toner images in a plurality of colors, respectively, is aligned in a rotation direction of an intermediate transfer belt.

The image forming apparatus 100 includes four photoconductive drums 20Y, 20C, 20M, and 20K serving as image bearers that bear yellow, cyan, magenta, and black toner images in separation colors, respectively, that is, yellow, cyan, magenta, and black.

The yellow, cyan, magenta, and black toner images formed on the photoconductive drums 20Y, 20C, 20M, and 20K as visible images, respectively, are primarily transferred successively onto an intermediate transfer belt 11 serving as an intermediate transferor disposed opposite the photoconductive drums 20Y, 20C, 20M, and 20K as the intermediate transfer belt 11 rotates in a rotation direction A1 such that the yellow, cyan, magenta, and black toner images are superimposed on a same position on the intermediate transfer belt 11 in a primary transfer process. Thereafter, the yellow, cyan, magenta, and black toner images superimposed on the intermediate transfer belt 11 are secondarily transferred onto a sheet S serving as a recording medium collectively in a secondary transfer process. Each of the photoconductive drums 20Y, 20C, 20M, and 20K is surrounded by image forming components that form the yellow, cyan, magenta, and black toner images on the photoconductive drums 20Y, 20C, 20M, and 20K as they rotate clockwise in FIG. 1 in a rotation direction D20.

Taking the photoconductive drum 20K that forms the black toner image, the following describes a construction of components that form the black toner image. The photoconductive drum 20K is surrounded by a charger 30K, a developing device 40K, a primary transfer roller 12K, and a cleaner 50K in this order in the rotation direction D20 of the photoconductive drum 20K. The photoconductive drums 20Y, 20C, and 20M are also surrounded by chargers 30Y, 30C, and 30M, developing devices 40Y, 40C, and 40M, primary transfer rollers 12Y, 12C, and 12M, and cleaners 50Y, 50C, and 50M in this order in the rotation direction D20 of the photoconductive drums 20Y, 20C, and 20M, respectively. The charger 30K uniformly changes an outer circumferential surface of the photoconductive drum 20K. An optical writing device 8 optically writes an electrostatic latent image on the charged outer circumferential surface of the photoconductive drum 20K according to image data sent from an external device such as a client computer. The developing device 40K visualizes the electrostatic latent image as a black toner image.

As the intermediate transfer belt 11 rotates in the rotation direction A1, the yellow, cyan, magenta, and black toner images formed on the photoconductive drums 20Y, 20C, 20M, and 20K, respectively, are primarily transferred successively onto the intermediate transfer belt 11, thus being superimposed on the same position on the intermediate transfer belt 11 and formed into a color toner image. In the primary transfer process, the primary transfer rollers 12Y, 12C, 12M, and 12K disposed opposite the photoconductive drums 20Y, 20C, 20M, and 20K via the intermediate transfer belt 11, respectively, apply a primary transfer bias to the photoconductive drums 20Y, 20C, 20M, and 20K successively from the upstream photoconductive drum 20Y to the downstream photoconductive drum 20K in the rotation direction A1 of the intermediate transfer belt 11. The photoconductive drums 20Y, 20C, 20M, and 20K are aligned in this order in the rotation direction A1 of the intermediate transfer belt 11. The photoconductive drums 20Y, 20C, 20M, and 20K are located in four image forming stations that form the yellow, cyan, magenta, and black toner images, respectively.

The image forming apparatus 100 includes the four image forming stations that form the yellow, cyan, magenta, and black toner images, respectively, an intermediate transfer belt unit 10, a secondary transfer roller 5, an intermediate transfer belt cleaner 13, and the optical writing device 8. The intermediate transfer belt unit 10 is situated above and disposed opposite the photoconductive drums 20Y, 20C, 20M, and 20K. The intermediate transfer belt unit 10 incorporates the intermediate transfer belt 11 and the primary transfer rollers 12Y, 12C, 12M, and 12K. The secondary transfer roller 5 serves as a secondary transferor disposed opposite the intermediate transfer belt 11 and driven and rotated in accordance with rotation of the intermediate transfer belt 11. The intermediate transfer belt cleaner 13 is disposed opposite the intermediate transfer belt 11 to clean the intermediate transfer belt 11. The optical writing device 8 is situated below and disposed opposite the four image forming stations.

The optical writing device 8 includes a semiconductor laser serving as a light source, a coupling lens, an ID lens, a troidal lens, a deflection mirror, and a rotatable polygon mirror serving as a deflector. The optical writing device 8 emits light beams Lb corresponding to the yellow, cyan, magenta, and black toner images to be formed on the photoconductive drums 20Y, 20C, 20M, and 20K thereto, forming electrostatic latent images on the photoconductive drums 20Y, 20C, 20M, and 20K, respectively. FIG. 1 illustrates the light beam Lb irradiating the photoconductive drum 20K. Similarly, light beams irradiate the photoconductive drums 20Y, 20C, and 20M, respectively.

The image forming apparatus 100 further includes a sheet feeder 61 and a registration roller pair 4. The sheet feeder 61, disposed in a lower portion of the image forming apparatus 100, incorporates a paper tray that loads a plurality of sheets S to be conveyed to a secondary transfer nip formed between the intermediate transfer belt 11 and the secondary transfer roller 5. The registration roller pair 4 serving as a conveyor conveys the sheet S conveyed from the sheet feeder 61 to the secondary transfer nip formed between the intermediate transfer belt 11 and the secondary transfer roller 5 at a predetermined time when the yellow, cyan, magenta, and black toner images superimposed on the intermediate transfer belt 11 reach the secondary transfer nip. The image forming apparatus 100 further includes a sensor for detecting that a leading edge of the sheet S reaches the registration roller pair 4.

The secondary transfer roller 5 secondarily transfers the color toner image formed on the intermediate transfer belt 11 onto the sheet S as the sheet S is conveyed through the secondary transfer nip. The sheet S bearing the color toner image is conveyed to a fixing device 150 where the color toner image is fixed on the sheet S under heat and pressure. An output roller pair 7 ejects the sheet S bearing the fixed color toner image onto an output tray disposed atop the image forming apparatus 100. In an upper portion of the image forming apparatus 100 and below the output tray are toner bottles 9Y, 9C, 9M, and 9K containing fresh yellow, cyan, magenta, and black toners, respectively.

The intermediate transfer belt unit 10 includes a driving roller 72 and a driven roller 73 over which the intermediate transfer belt 11 is looped, in addition to the intermediate transfer belt 11 and the primary transfer rollers 12Y, 12C, 12M, and 12K. Since the driven roller 73 also serves as a tension applicator that applies tension to the intermediate transfer belt 11, a biasing member (e.g., a spring) biases the driven roller 73 against the intermediate transfer belt 11. The intermediate transfer belt unit 10, the primary transfer rollers 12Y, 12C, 12M, and 12K, the secondary transfer roller 5, and the intermediate transfer belt cleaner 13 constitute a transfer device 71. The sheet feeder 61 includes a feed roller 3 that contacts an upper side of an uppermost sheet S of the plurality of sheets S loaded on the paper tray of the sheet feeder 61. As the feed roller 3 is driven and rotated counterclockwise in FIG. 1, the feed roller 3 feeds the uppermost sheet S to the registration roller pair 4.

The intermediate transfer belt cleaner 13 of the transfer device 71 includes a cleaning brush and a cleaning blade disposed opposite the intermediate transfer belt 11 to come into contact with the intermediate transfer belt 11. The cleaning brush and the cleaning blade scrape a foreign substance such as residual toner particles off the intermediate transfer belt 11, removing the foreign substance from the intermediate transfer belt 11 and thereby cleaning the intermediate transfer belt 11. The intermediate transfer belt cleaner 13 further includes a waste toner conveyer that conveys the residual toner particles removed from the intermediate transfer belt 11.

Figure 2:
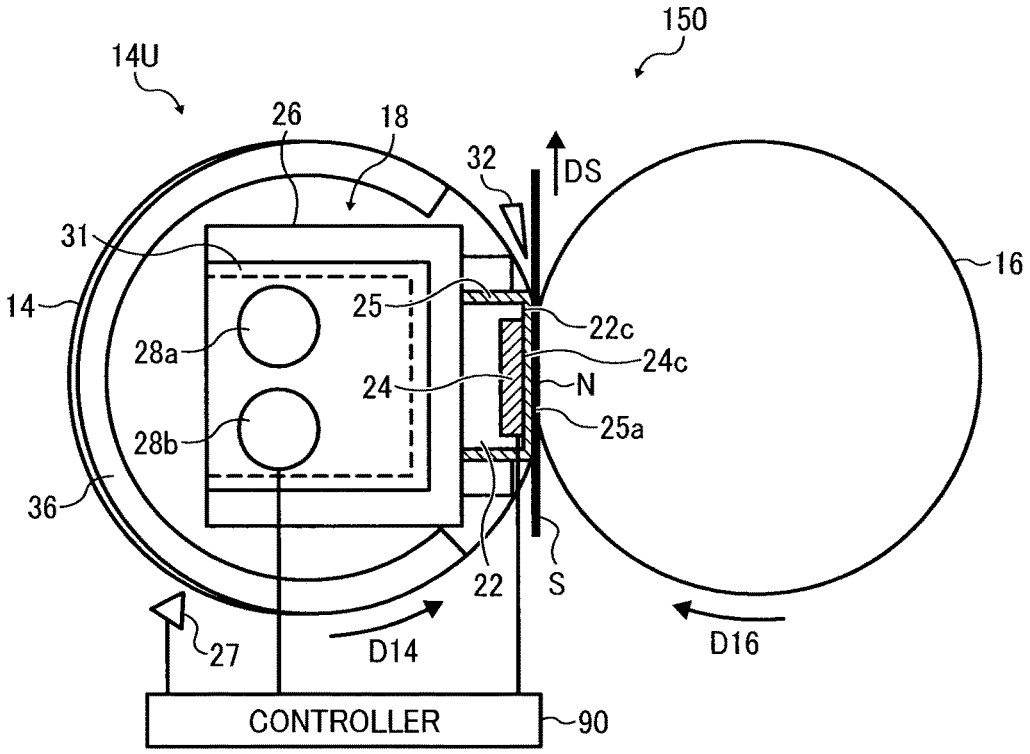
FIG. 2 is a schematic vertical sectional view of a fixing device incorporated in the image forming apparatus shown in FIG. 1.

With reference to FIG. 2, a description is provided of a configuration of the fixing device 150 incorporated in the image forming apparatus 100 having the construction described above.

FIG. 2 is a schematic vertical sectional view of the fixing device 150. As shown in FIG. 2, the fixing device 150 (e.g., a fuser or a fusing unit) includes a thin, flexible, endless fixing belt 14, serving as an endless belt, a fixing rotator, or a fixing member, formed into a loop and rotatable in a rotation direction D14 and a pressure roller 16 serving as an opposed rotator disposed outside the loop formed by the fixing belt 14 and disposed opposite the fixing belt 14. The pressure roller 16 is rotatable in a rotation direction D16. The fixing belt 14 is tubular or cylindrical. Inside the loop formed by the fixing belt 14 is a nip formation assembly 18 (e.g., a nip formation unit) that forms a fixing nip N between the fixing belt 14 and the pressure roller 16, through which the sheet S is conveyed.

A detailed description is now given of a construction of the nip formation assembly 18.

The nip formation assembly 18 includes a nip formation pad 22, a lateral end heater 24, a supplementary thermal conductor 25, and a stay 26. The nip formation pad 22, disposed inside the loop formed by the fixing belt 14 and disposed opposite the pressure roller 16, presses against the pressure roller 16 via the fixing belt 14 to form the fixing nip N between the fixing belt 14 and the pressure roller 16. The lateral end heater 24 serving as a lateral end heater or a lateral end heat source is mounted on each lateral end of the nip formation pad 22 in a longitudinal direction thereof parallel to an axial direction of the fixing belt 14, thus being coupled with the nip formation pad 22. The supplementary thermal conductor 25 coupled with the nip formation pad 22 covers a nip formation face 22*c* of the nip formation pad 22 that is disposed opposite an inner circumferential surface of the fixing belt 14 and a fixing belt side face 24*c*, serving as a fixing rotator side face, of the lateral end heater 24 that is disposed opposite the inner circumferential surface of the fixing belt 14. The stay 26 supports the nip formation pad 22 against pressure from the pressure roller 16.

Each of the nip formation pad 22, the supplementary thermal conductor 25, and the stay 26 has a width not smaller than a width of the fixing belt 14 in the axial direction thereof parallel to a longitudinal direction of the nip formation pad 22, the supplementary thermal conductor 25, and the stay 26. The supplementary thermal conductor 25 prevents heat generated by the lateral end heater 24 from being stored locally and facilitates diffusion and conduction of heat, thus reducing uneven temperature of the fixing belt 14 in the axial direction thereof caused by heating by the lateral end heater 24. Hence, the supplementary thermal conductor 25 is made of a material that conducts heat quickly, for example, a material having an increased thermal conductivity such as copper, aluminum, and silver. It is preferable that the supplementary thermal conductor 25 is made of copper in a comprehensive view of manufacturing costs, availability, thermal conductivity, and processing.

The supplementary thermal conductor 25 includes a contact face 25*a* disposed opposite or in contact with the inner circumferential surface of the fixing belt 14.

Figure 3:
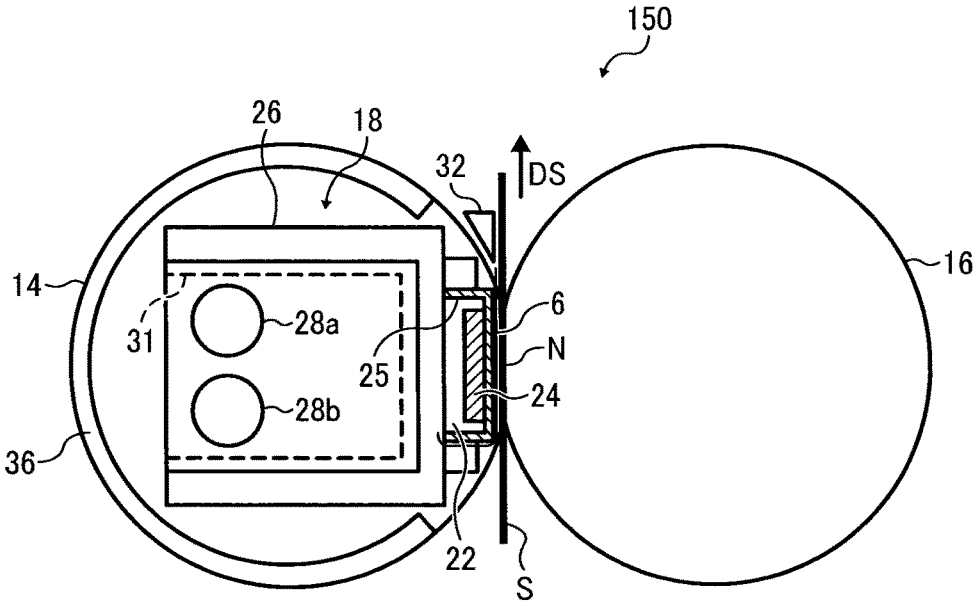
FIG. 3 is a schematic vertical sectional view of the fixing device shown in FIG. 2 illustrating a low-friction sheet incorporated therein.

The inner circumferential surface of the fixing belt 14 slides over the supplementary thermal conductor 25 via a low-friction sheet 6 serving as a slide sheet as shown in FIG. 3. FIG. 3 is a schematic vertical sectional view of the fixing device 150 illustrating the low-friction sheet 6. The low-friction sheet 6 is applied with a lubricant such as fluorine grease and silicone oil to decrease a slide torque of the fixing belt 14. Alternatively, the supplementary thermal conductor 25 may contact the inner circumferential surface of the fixing belt 14 directly without the low-friction sheet 6 interposed between the supplementary thermal conductor 25 and the fixing belt 14.

The stay 26 has a box shape with an opening opposite the fixing nip N. Two halogen heaters 28*a* and 28*b* serving as a fixing heater or a fixing heat source are disposed inside the box of the stay 26. The halogen heaters 28*a* and 28*b* emit light that irradiates the inner circumferential surface of the fixing belt 14 directly through the opening of the stay 26 opposite the fixing nip N, heating the fixing belt 14 with radiation heat.

A platy reflector 31 is mounted on an interior surface of the stay 26 to reflect light radiated from the halogen heaters 28*a* and 28*b* toward the fixing belt 14 so as to improve heating efficiency of the halogen heaters 28*a* and 28*b* to heat the fixing belt 14. The reflector 31 prevents light radiated from the halogen heaters 28*a* and 28*b* from heating the stay 26, suppressing waste of energy. Alternatively, instead of the reflector 31, the interior surface of the stay 26 may be treated with insulation or mirror finish to reflect light radiated from the halogen heaters 28*a* and 28*b* toward the fixing belt 14.

A detailed description is now given of a construction of the pressure roller 16.

Figure 4:
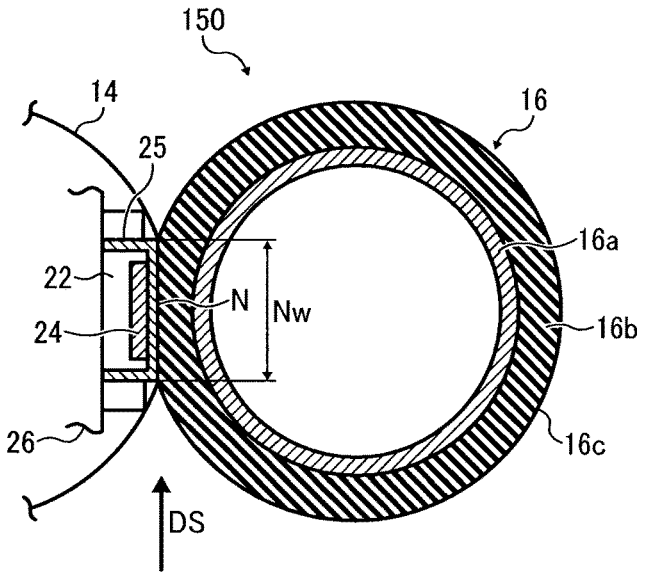
FIG. 4 is a partial vertical sectional view of the fixing device shown in FIG. 2.

FIG. 4 is a partial vertical sectional view of the fixing device 150. As shown in FIG. 4, the pressure roller 16 is constructed of a hollow metal roller 16*a*, an elastic layer 16*b* coating an outer circumferential surface of the metal roller 16*a* and being made of silicone rubber, and a release layer 16*c* coating an outer circumferential surface of the elastic layer 16*b*. The release layer 16*c*, having a layer thickness in a range of from 5 micrometers to 50 micrometers, is made of perfluoroalkoxy fluoro resin (PFA) or polytetrafluoroethylene (PTFE) to facilitate separation of the sheet S from the pressure roller 16. As a driving force generated by a driver (e.g., a motor) situated inside the image forming apparatus 100 depicted in FIG. 1 is transmitted to the pressure roller 16 through a gear train, the pressure roller 16 rotates in the rotation direction D16 as shown in FIG. 2. Alternatively, the driver may also be connected to the fixing belt 14 to drive and rotate the fixing belt 14. A spring or the like biases the pressure roller 16 against the fixing belt 14. As the elastic layer 16*b* of the pressure roller 16 is pressed and deformed, the pressure roller 16 produces the fixing nip N defined by a circumferential fixing nip span having a predetermined length Nw in a sheet conveyance direction DS as shown in FIG. 4.

Alternatively, the pressure roller 16 may be a solid roller. However, a hollow roller has a decreased thermal capacity. Further, a heater or a heat source such as a halogen heater may be disposed inside the pressure roller 16. The elastic layer 16*b* may be made of solid rubber. Alternatively, if no heater is situated inside the pressure roller 16, the elastic layer 16*b* may be made of sponge rubber. The sponge rubber is more preferable than the solid rubber because the sponge rubber has an increased insulation that draws less heat from the fixing belt 14.

A detailed description is now given of a construction of the fixing belt 14.

The fixing belt 14 is an endless belt or film having a layer thickness in a range of from 30 micrometers to 50 micrometers and made of metal such as nickel and SUS stainless steel or resin such as polyimide. The fixing belt 14 is constructed of a base layer and a release layer. The release layer constituting an outer surface layer is made of PFA, PTFE, or the like to facilitate separation of toner of a toner image on the sheet S from the fixing belt 14, thus preventing the toner of the toner image from adhering to the fixing belt 14.

Optionally, an elastic layer may be sandwiched between the base layer and the release layer and made of silicone rubber or the like. If the fixing belt 14 does not incorporate the elastic layer, the fixing belt 14 has a decreased thermal capacity that improves fixing property of being heated quickly to a desired fixing temperature at which the toner image is fixed on the sheet S. However, as the pressure roller 16 and the fixing belt 14 sandwich and press the unfixed toner image on the sheet S passing through the fixing nip N, slight surface asperities of the fixing belt 14 may be transferred onto the toner image on the sheet S, resulting in variation in gloss of the solid toner image on the sheet S.

To address this circumstance, the elastic layer made of silicone rubber has a thickness not smaller than 100 micrometers. As the elastic layer deforms, the elastic layer absorbs slight surface asperities of the fixing belt 14, suppressing variation in gloss of the toner image on the sheet S. As the pressure roller 16 rotates in the rotation direction D16 as shown in FIG. 2, the fixing belt 14 rotates in the rotation direction D14 in accordance with rotation of the pressure roller 16 by friction therebetween. At the fixing nip N, the fixing belt 14 rotates as it is sandwiched between the pressure roller 16 and the nip formation pad 22; at a circumferential span of the fixing belt 14 other than the fixing nip N, the fixing belt 14 rotates while the fixing belt 14 is supported at each lateral end in the axial direction thereof to retain a tubular shape. Thus, the fixing belt 14 is retained circular in cross-section stably. As shown in FIG. 2, a separator 32 is disposed downstream from the fixing nip N in the sheet conveyance direction DS to separate the sheet S from the fixing belt 14.

According to this exemplary embodiment, as shown in FIGS. 2 to 4, the fixing nip N is planar. Alternatively, the fixing nip N may define a curve projecting toward the fixing belt 14 to produce a recess in the fixing belt 14 in cross-section or other shapes. If the fixing nip N defines the recess in the fixing belt 14, the recessed fixing nip N directs the leading edge of the sheet S toward the pressure roller 16 as the sheet S is ejected from the fixing nip N, facilitating separation of the sheet S from the fixing belt 14 and suppressing jamming of the sheet S. In this case, the nip formation face 22*c* of the nip formation pad 22 is contoured into the recess. Similarly, the supplementary thermal conductor 25 may have a decreased thickness and the contact face 25*a* of the supplementary thermal conductor 25 may be contoured along the recessed nip formation face 22*c* of the nip formation pad 22.

A detailed description is now given of a configuration of the stay 26.

The stay 26 supports the nip formation pad 22 against pressure from the pressure roller 16 to prevent bending of the nip formation pad 22 and produce the even length Nw of the fixing nip N in the sheet conveyance direction DS throughout the entire width of the fixing belt 14 in the axial direction thereof. According to this exemplary embodiment, the pressure roller 16 is pressed against the fixing belt 14 to form the fixing nip N. Alternatively, the nip formation assembly 18 may be pressed against the pressure roller 16 to from the fixing nip N. The stay 26 has a mechanical strength great enough to support the nip formation pad 22 to prevent bending of the nip formation pad 22. The stay 26 is made of metal such as stainless steel and iron or metallic oxide such as ceramic. The fixing belt 14 and the components disposed inside the loop formed by the fixing belt 14, that is, the halogen heaters 28*a* and 28*b*, the nip formation pad 22, the lateral end heater 24, the supplementary thermal conductor 25, the stay 26, and the reflector 31, may constitute a belt unit 14U separably coupled with the pressure roller 16.

Figure 5:
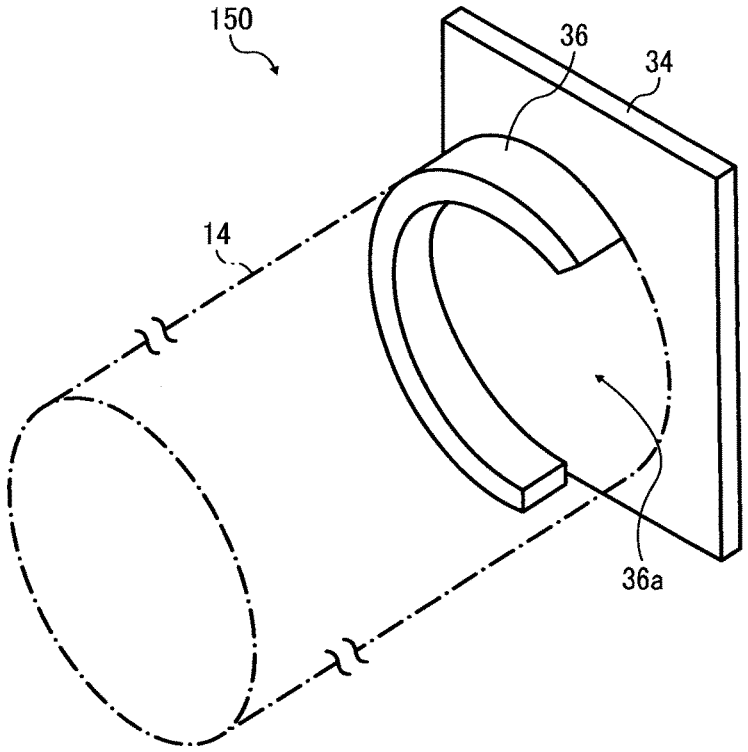
FIG. 5 is a partial perspective view of the fixing device shown in FIG. 2.

FIG. 5 is a partial perspective view of the fixing device 150. As shown in FIG. 5, both lateral ends of the fixing belt 14 in the axial direction thereof are rotatably supported by flanges 36, respectively. Each of the flanges 36 serves as a support projecting from a side plate 34 in the axial direction of the fixing belt 14. Although FIG. 5 illustrates the flange 36 and the side plate 34 situated at one lateral end of the fixing belt 14 in the axial direction thereof, the flange 36 and the side plate 34 are also situated at another lateral end of the fixing belt 14 in the axial direction thereof. The flange 36 that guides each lateral end of the fixing belt 14 in the axial direction thereof has an outer diameter substantially equivalent to an inner diameter of the fixing belt 14. The flange 36 projects inboard from a lateral edge of the fixing belt 14 by a length in a range of from 5 mm to 10 mm in the axial direction of the fixing belt 14. The flanges 36 guide the fixing belt 14 even when the fixing belt 14 rotates, retaining the fixing belt 14 to be circular in cross-section.

The flange 36 includes a slit 36*a* disposed opposite the fixing nip N to place the nip formation assembly 18 at a predetermined position. The stay 26 depicted in FIG. 2 has a width that spans the entire width of the fixing belt 14 in the axial direction thereof. Both lateral ends of the stay 26 in the axial direction of the fixing belt 14 are fixedly secured on the side plates 34, respectively, thus being supported and positioned by the side plates 34.

Figure 6:
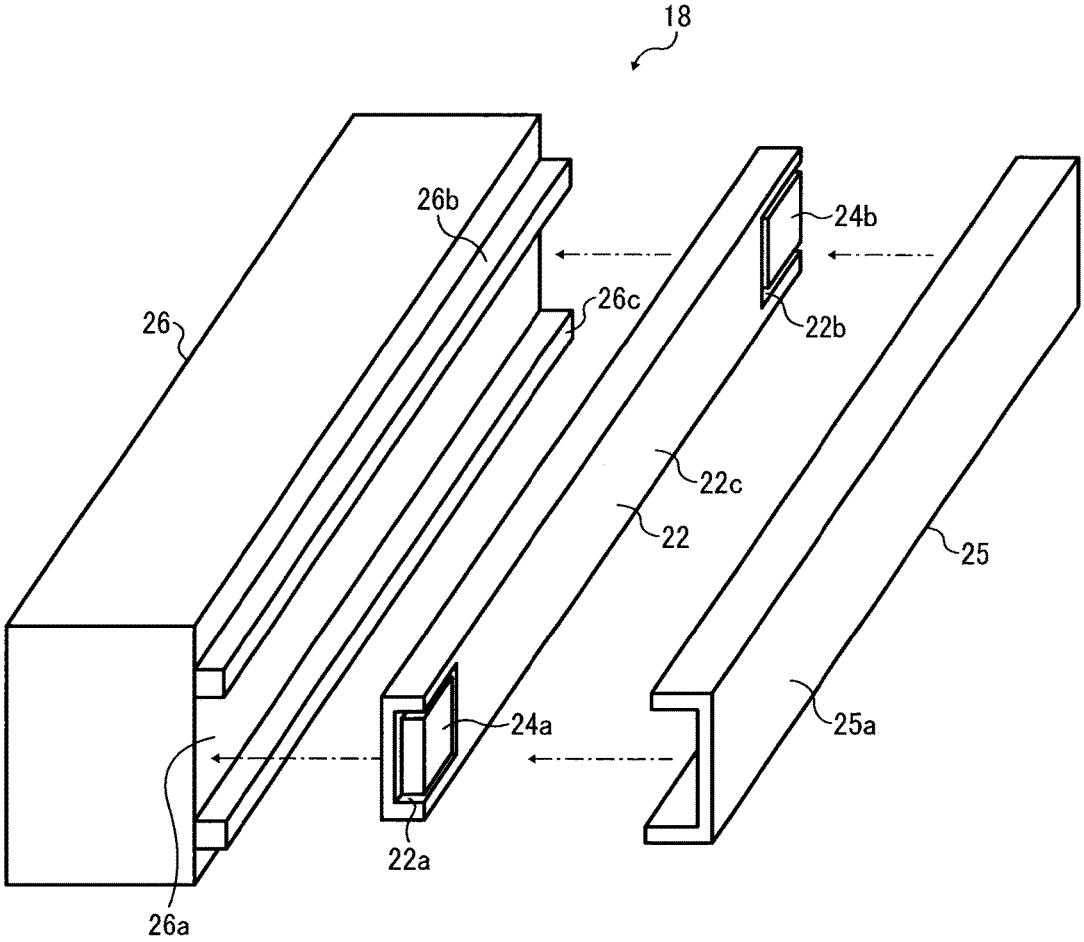
FIG. 6 is an exploded perspective view of a nip formation assembly incorporated in the fixing device shown in FIG. 2.

FIG. 6 is an exploded perspective view of the nip formation assembly 18. As shown in FIG. 6, the lateral end heater 24 depicted in FIG. 2 includes lateral end heaters 24*a* and 24*b*. A side face 26*a* of the stay 26 that faces the pressure roller 16 mounts two ridges 26*b* and 26*c* (e.g., projections) extending in the axial direction of the fixing belt 14. The supplementary thermal conductor 25 engages the rectangular nip formation pad 22 such that the supplementary thermal conductor 25 covers the nip formation face 22*c* of the nip formation pad 22 that is disposed opposite the inner circumferential surface of the fixing belt 14, thus being coupled with the nip formation pad 22. The supplementary thermal conductor 25 coupled with the nip formation pad 22 is sandwiched and positioned between the two ridges 26*b* and 26*c* in the sheet conveyance direction DS and is attached to the side face 26*a* with an adhesive or the like. Thus, the side face 26*a* and the two ridges 26*b* and 26*c* accommodate the supplementary thermal conductor 25 and the nip formation pad 22. Two recesses 22*a* and 22*b* that define a difference in thickness of the nip formation pad 22 are disposed at both lateral ends of the nip formation pad 22 in the longitudinal direction thereof. The lateral end heaters 24*a* and 24*b* that constitute the lateral end heater 24 depicted in FIG. 2 are attached to the recesses 22*a* and 22*b* with an adhesive or the like or mounted on the recesses 22*a* and 22*b*, respectively, thus being accommodated by the recesses 22*a* and 22*b*.

The supplementary thermal conductor 25 includes the contact face 25*a* that faces the pressure roller 16 and serves as a nip formation face that forms the fixing nip N. However, since the nip formation face 22*c* of the nip formation pad 22 has a mechanical strength greater than that of the contact face 25*a* of the supplementary thermal conductor 25, the nip formation face 22*c* that faces the pressure roller 16 serves as a nip formation face that forms the fixing nip N practically.

A description is provided of a construction of the lateral end heaters 24*a* and 24*b*.

Figure 7:
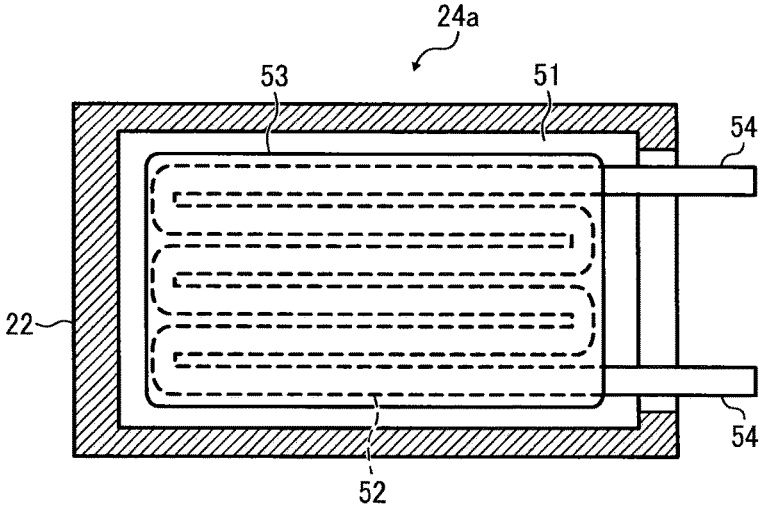
FIG. 7 is a plan view of a lateral end heater incorporated in the nip formation assembly shown in FIG. 6.

FIG. 7 is a plan view of the lateral end heater 24*a*. Since the lateral end heaters 24*a* and 24*b* have an identical construction, FIG. 7 illustrates the lateral end heater 24*a*. The lateral end heater 24*a* includes a ceramic base 51, a resistive heat generator 52 layered on the base 51 with patterning, and an insulative layer 53 layered on the resistive heat generator 52. The base 51 has an outer size of about 10 mm×about 20 mm. The resistive heat generator 52 is a heat generator. The insulative layer 53 is a thin glass layer. Terminals 54, disposed at each lateral end of the lateral end heater 24*a* in the axial direction of the fixing belt 14, are connected to a power supply and a switching element.

As described above, the resistive heat generator 52 is mounted on a first face of the lateral end heater 24*a* so that the first face of the lateral end heater 24*a* that mounts the resistive heat generator 52 generates heat mainly while a second face of the lateral end heater 24*a* that does not mount the resistive heat generator 52 barely receives heat from the first face. According to this exemplary embodiment, the first face of the lateral end heater 24*a* that mounts the resistive heat generator 52 contacts the recess 22*a* depicted in FIG. 6. The terminals 54 are mounted on the first face of the lateral end heater 24*a*.

Figure 8:
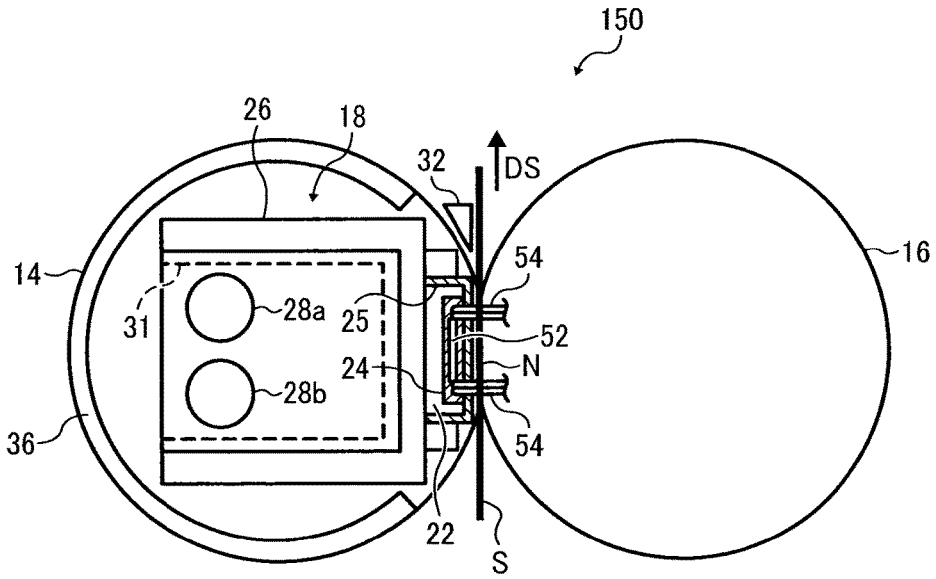
FIG. 8 is a schematic vertical sectional view of the fixing device shown in FIG. 2 illustrating the lateral end heater shown in FIG. 7.

FIG. 8 is a schematic vertical sectional view of the fixing device 150 illustrating the lateral end heater 24 (e.g., the lateral end heaters 24*a* and 24*b*). As shown in FIG. 8, the first face of the lateral end heater 24 that mounts the resistive heat generator 52 is isolated from the fixing belt 14. Accordingly, even if the insulative layer 53 depicted in FIG. 7 is broken, power supplied to the lateral end heater 24 is not transmitted to the fixing belt 14. If the fixing belt 14 is made of metal as described below, power may be transmitted to other components disposed inside the image forming apparatus 100 through metal of the fixing belt 14, for example, a thermistor contacting the fixing belt 14, thus adversely affecting the thermistor. To address this circumstance, the above-described configuration secures a predetermined interval between the inner circumferential surface of the fixing belt 14 and the resistive heat generator 52 extending along the inner circumferential surface of the fixing belt 14.

Figure 9:
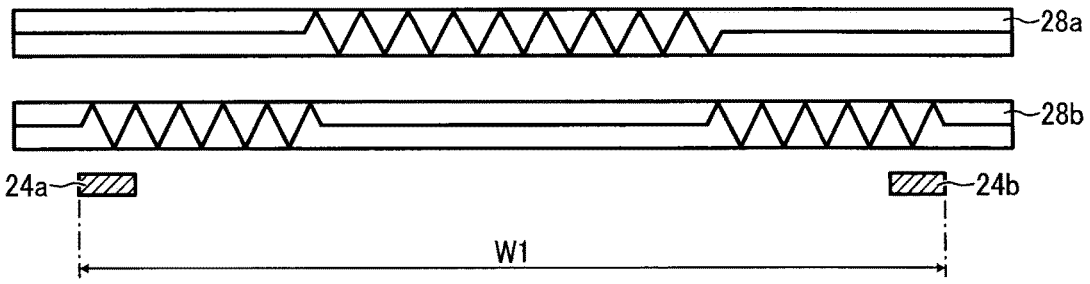
FIG. 9 is a plan view of halogen heaters and lateral end heaters incorporated in the fixing device shown in FIG. 2.

FIG. 9 is a plan view of the halogen heaters 28*a* and 28*b*. FIG. 9 illustrates a width W1 of an A3 size sheet in portrait orientation in the axial direction of the fixing belt 14. As shown in FIG. 9, the halogen heater 28*a* is a center heater having a dense light distribution at a center span of the halogen heater 28*a* disposed opposite a center span of the fixing belt 14 in the axial direction thereof where a small sheet S (e.g., a B5 size sheet) having a decreased width in the axial direction of the fixing belt 14 is conveyed over the fixing belt 14. Conversely, the halogen heater 28*b* is a lateral end heater having a dense light distribution at a lateral end span of the halogen heater 28*b* disposed opposite a lateral end span of the fixing belt 14 in the axial direction thereof where a large sheet S (e.g., an A3 size sheet) having an increased width in the axial direction of the fixing belt 14 is conveyed over the fixing belt 14.

As the small sheet S is conveyed over the fixing belt 14, the halogen heater 28*a* is powered on and the halogen heater 28*b* is not powered on, thus preventing the lateral end span of the fixing belt 14 where the small sheet S is not conveyed from being heated unnecessarily or preventing overheating of the lateral end span of the fixing belt 14 in the axial direction thereof after a plurality of small sheets S is conveyed over the center span of the fixing belt 14 in the axial direction thereof continuously. At least a part of a heating span of the lateral end heaters 24*a* and 24*b* in the axial direction of the fixing belt 14 overlaps an outboard part of a heating span of the halogen heater 28*b* in the axial direction of the fixing belt 14. In other words, the lateral end heaters 24*a* and 24*b* supplement decrease in heat output of the outboard part of the halogen heater 28*b* that suffers from a decreased heat output.

A description is provided of a configuration of a first comparative fixing device incorporating the halogen heaters 28*a* and 28*b*.

Figure 10:
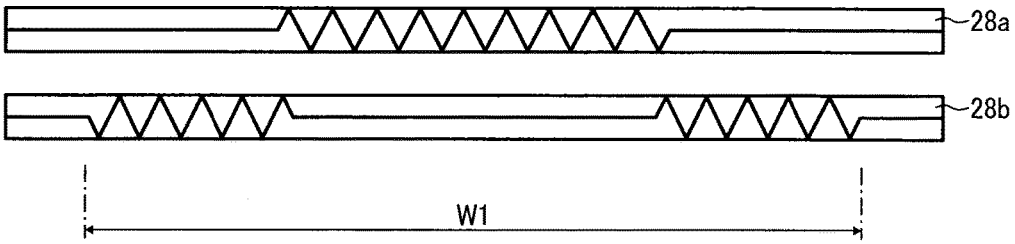
FIG. 10 is a plan view of halogen heaters incorporated in a first comparative fixing device.

FIG. 10 is a plan view of the halogen heaters 28*a* and 28*b* of the first comparative fixing device. As a small sheet S (e.g., a B5 size sheet) is conveyed through the fixing nip N, the halogen heater 28*a* having the center dense light distribution is powered on. As a large sheet S (e.g., an A3 size sheet) is conveyed through the fixing nip N, the halogen heater 28*b* having the lateral end dense light distribution is powered on together with the halogen heater 28*a*. The halogen heaters 28*a* and 28*b* are powered on and off properly to heat sheets S of various sizes.

Taking the sizes of the sheets S and the frequency with which the sheets S are conveyed, sheets S up to the A3 size sheet are used frequently. The A3 size sheet is conveyed through the fixing nip N in portrait orientation. An A4 size sheet and a letter (LT) size sheet that are used with an increased frequency are generally conveyed in landscape orientation to enhance productivity. To address this circumstance, the halogen heaters 28*a* and 28*b* produce a heating span of about 300 mm in the axial direction of the fixing belt 14 that is great enough to heat 99 percent or more of the sizes of sheets S. On the other hand, the halogen heaters 28*a* and 28*b* are requested to heat large sheets S greater than the A3 size sheet in the axial direction of the fixing belt 14 such as an A3 extension size sheet and a 13-inch sheet although the large sheets S are used infrequently. The A3 extension size sheet is slightly greater than the A3 size sheet in a width direction thereof parallel to the axial direction of the fixing belt 14.

If a plurality of halogen heaters is used to heat the fixing belt 14, the plurality of halogen heaters used to heat the small sheet S is situated inside the loop formed by the fixing belt 14 or a fixing roller having a diameter of about 30 mm. Accordingly, the number of the halogen heaters is limited. To address this circumstance, the halogen heater 28*b* having the lateral end dense light distribution may be elongated to span a width of the large sheet S greater than a width of the A3 size sheet in the axial direction of the fixing belt 14.

As described above, the halogen heaters 28*a* and 28*b* heat the heating span of about 300 mm of the fixing belt 14 in the axial direction thereof frequently. However, if the elongated halogen heater 28*b* is employed, the elongated halogen heater 28*b* may heat an elongated heating span of about 330 mm of the fixing belt 14 in the axial direction thereof, wasting energy used to heat a differential between the heating span of about 300 mm and the elongated heating span of about 330 mm.

When the A3 size sheet in portrait orientation or the A4 size sheet in landscape orientation is conveyed through the fixing nip N, each lateral end of the elongated heating span of about 330 mm of the fixing belt 14 in the axial direction thereof that corresponds to the differential between the heating span of about 300 mm and the elongated heating span of about 330 mm may overheat. In order to cool the overheated lateral end of the fixing belt 14, productivity defined by a conveyance speed of the sheets S may be degraded or a fan may be installed. If a reflection plate is interposed between the halogen heater 28*b* and the fixing belt 14, each lateral end of the halogen heater 28*b* in the axial direction of the fixing belt 14 may overheat.

To address this circumstance, a second comparative fixing device is proposed.

The second comparative fixing device includes a thin, flexible endless belt to be heated quickly to a fixing temperature at which a toner image is fixed on a sheet S and a nip formation unit located inside a loop formed by the endless belt. The nip formation unit presses against a pressure roller via the endless belt to form a fixing nip between the endless belt and the pressure roller. A plurality of halogen heaters having different light distributions in an axial direction of the endless belt parallel to a width direction of the sheet S, respectively, is situated inside the loop formed by the endless belt. A plurality of lateral end heaters is disposed opposite both lateral end spans of the endless belt in the axial direction thereof, respectively, and upstream from the fixing nip in a rotation direction of the endless belt so as to heat an increased heating span of the endless belt corresponding to the width of the large sheet S in the axial direction of the endless belt. The lateral end heaters locally contact an inner circumferential surface or an outer circumferential surface of the endless belt. The local lateral end heaters heat the increased heating span of the endless belt corresponding to the width of the large sheet S in the axial direction of the endless belt with a simple construction not incorporating an extra halogen heater directed to the large sheet S.

The lateral end heaters disposed upstream from the fixing nip in the rotation direction of the endless belt heat both lateral ends of the endless belt in the axial direction thereof, respectively. While the endless belt rotates, both lateral ends of the endless belt in the axial direction thereof may flap and therefore contact the lateral end heaters unstably. To address this circumstance, the lateral end heaters press against both lateral ends of the endless belt in the axial direction thereof with predetermined pressure. However, since the endless belt is exerted with pressure at a portion other than the fixing nip, the endless belt may suffer from faulty rotation.

Additionally, the lateral end heaters may melt residual toner failed to be fixed on the sheet S at the fixing nip and therefore remaining on the endless belt again on both lateral end spans of the endless belt disposed opposite the lateral end heaters, respectively. Accordingly, the melted toner may adhere to the endless belt.

Figure 11:
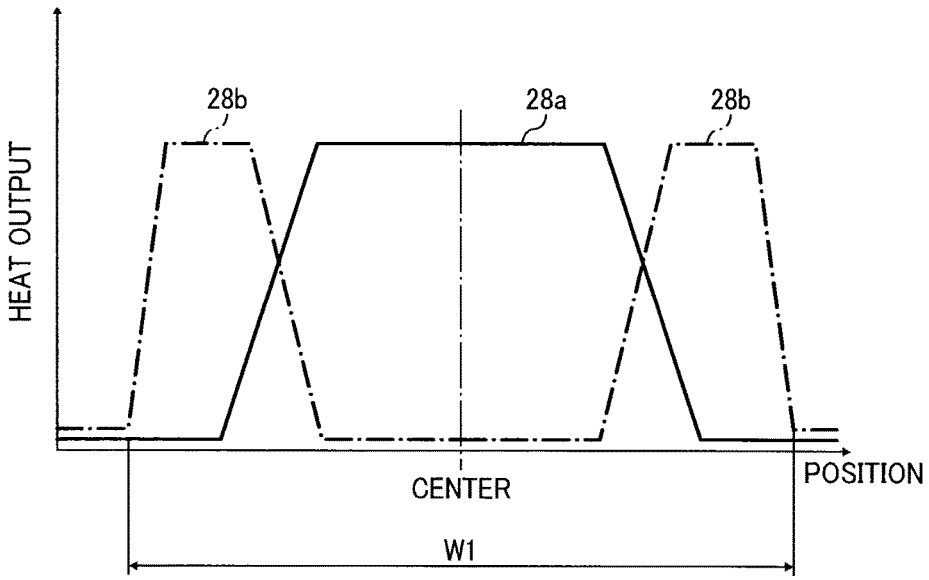
FIG. 11 is a graph showing temperature decrease in each lateral end of a comparative halogen heater.

FIG. 11 is a graph showing a relation between the position on the halogen heaters 28*a* and 28*b* in a longitudinal direction thereof and the heat output of the halogen heaters 28*a* and 28*b*. As shown in FIG. 11, both lateral end spans of each of the halogen heaters 28*a* and 28*b* in the longitudinal direction thereof have a decreased heat output that draws a trapezoid which indicates a property peculiar to halogen heaters. In order to heat the entire sheet S including each lateral end in the width direction thereof parallel to the axial direction of the fixing belt 14 sufficiently, a width of a light emitter of the halogen heater 28*b* attaining the dense light distribution at each lateral end of the fixing belt 14 in the axial direction thereof is requested to be greater than a width of the sheet S in the width direction thereof as shown in FIG. 11.

Figure 12:
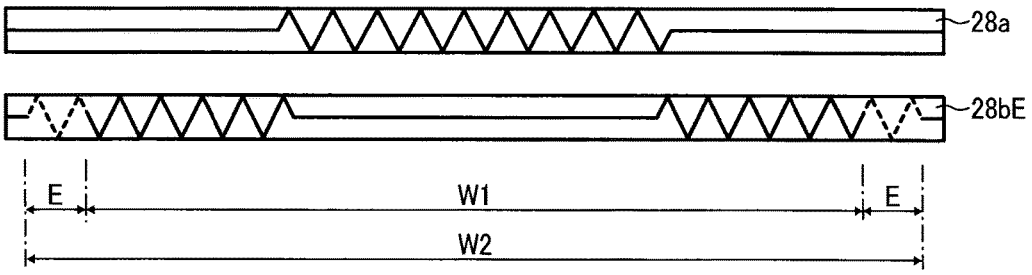
FIG. 12 is a plan view of the halogen heater of the first comparative fixing device shown in FIG. 10 and an elongated halogen heater.

FIG. 12 is a plan view of the halogen heater 28*a* and an elongated halogen heater 28*b*E having the elongated width in the axial direction of the fixing belt 14. However, the elongated halogen heater 28*b*E spans a width W2 of the A3 extension size sheet that is greater than the width W1 of the A3 size sheet in the axial direction of the fixing belt 14. Accordingly, a non-conveyance span, that is, an outboard span E where the A3 size sheet is not conveyed, that is outboard from a conveyance span corresponding to the width W1 in the axial direction of the fixing belt 14 may suffer from overheating or temperature increase after the A3 size sheets are conveyed over the fixing belt 14 continuously. To address this circumstance, a light shield may shield the non-conveyance span of the fixing belt 14 from redundant light emitted from the outboard span E of the elongated halogen heater 28*b*E. However, while the A3 size sheets are conveyed over the fixing belt 14 continuously, the light shield may overheat. Further, as the elongated halogen heater 28*b*E heats the non-conveyance span of the fixing belt 14, the elongated halogen heater 28*a*E consumes energy unnecessarily, wasting energy.

Figure 13:
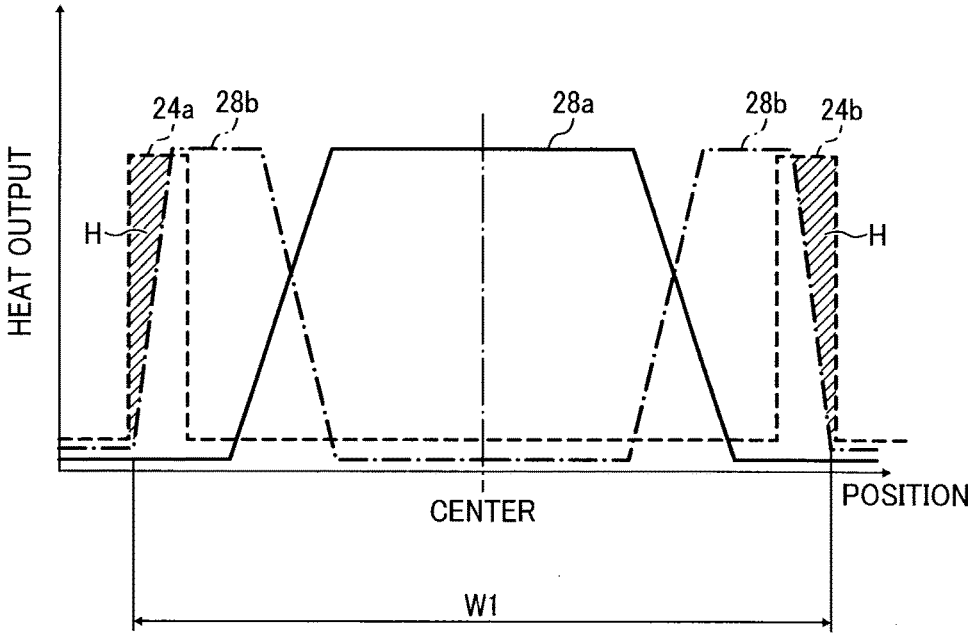
FIG. 13 is a graph showing the position on the halogen heaters and the lateral end heaters shown in FIG. 9 in an axial direction of a fixing belt and the heat output of the halogen heaters and the lateral end heaters.

With reference to FIG. 13, a description is provided of a configuration of the fixing device 150 to address the circumstances described above of the second comparative fixing device and the property peculiar to the halogen heaters.

FIG. 13 is a graph showing the position on the halogen heaters 28*a* and 28*b* and the lateral end heaters 24*a* and 24*b* in the axial direction of the fixing belt 14 and the heat output thereof. As shown in hatched parts H in FIG. 13, the lateral end heaters 24*a* and 24*b* supplement decrease in heat output of the part of the halogen heater 28*b* that suffers from the decreased heat output. The lateral end heaters 24*a* and 24*b* are directed to supplement decrease in heat output of the part of the halogen heater 28*b* that is disposed at each lateral end span of the halogen heater 28*b* in the longitudinal direction thereof and suffers from the decreased heat output. Hence, each of the lateral end heaters 24*a* and 24*b* is a downsized heater having a width of about 20 mm in the axial direction of the fixing belt 14.

The fixing device 150 according to this exemplary embodiment incorporates a simple mechanism in addition to the halogen heaters 28*a* and 28*b*, that is, the lateral end heaters 24*a* and 24*b* being disposed within the circumferential fixing nip span of the fixing nip N in a circumferential direction of the fixing belt 14. The lateral end heaters 24*a* and 24*b* are disposed opposite both lateral end spans of the fixing belt 14 or in proximity to both lateral ends of the fixing belt 14 in the axial direction thereof, respectively, thus addressing temperature decrease of both lateral end spans of the halogen heater 28*b* caused by the property peculiar to the halogen heaters.

The halogen heaters 28*a* and 28*b* and the lateral end heaters 24*a* and 24*b* are energized during an initial time of a print job of conveying sheets S continuously for fixing immediately after warming up the fixing device 150, for example, the initial time when the fixing belt 14 and the pressure roller 16 have not been heated sufficiently. Conversely, when the fixing belt 14 and the pressure roller 16 have been heated sufficiently and temperature decrease at each lateral end of the fixing belt 14 in the axial direction thereof that results from temperature decrease of each lateral end span of the halogen heater 28*b* caused by the property peculiar to the halogen heaters has been reduced, the halogen heaters 28*a* and 28*b* are energized or the halogen heater 28*a* is energized. Hence, the lateral end heaters 24*a* and 24*b* are not energized.

Under such heating control, the fixing device 150 reduces overheating or temperature increase in the non-conveyance span on the fixing belt 14 where the sheet S is not conveyed at each lateral end of the fixing belt 14 in the axial direction thereof. Additionally, the fixing belt 14 is not heated unnecessarily, improving heating efficiency and saving energy. Thus, the halogen heater 28*b* and the lateral end heaters 24*a* and 24*b* of the fixing device 150 according to this exemplary embodiment reduce waste of energy unlike the elongated halogen heater 28*b*E including the light emitter defining the outboard span E outboard from the A3 size sheet having the width W1 in the axial direction of the fixing belt 14 as shown in FIG. 12.

Figure 14:
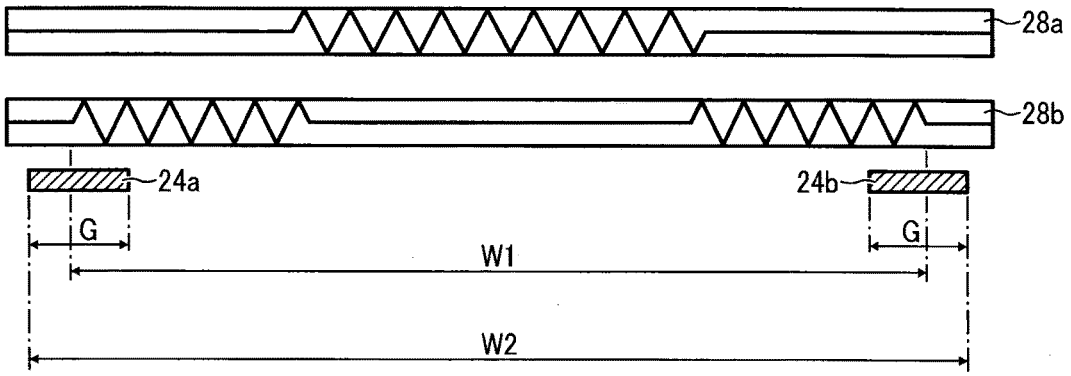
FIG. 14 is a plan view of the halogen heaters and the lateral end heaters incorporated in the fixing device shown in FIG. 2.

FIG. 14 is a plan view of the halogen heaters 28*a* and 28*b* and the lateral end heaters 24*a* and 24*b* illustrating the light distribution of the halogen heaters 28*a* and 28*b* and the positional relation between the halogen heaters 28*a* and 28*b* and the lateral end heaters 24*a* and 24*b*. As shown in FIG. 14, the lateral end heaters 24*a* and 24*b* have a width in the axial direction of the fixing belt 14 that is great enough to suppress temperature decrease of the part of the halogen heater 28*b* that is disposed at each lateral end span of the halogen heater 28*b* in the longitudinal direction thereof, which is caused by the property peculiar to the halogen heaters. Additionally, the halogen heater 28*b* and the lateral end heaters 24*a* and 24*b* attain a heating span great enough to span the width W2 of the large sheet S (e.g., the A3 extension size sheet and the 13-inch sheet), enhancing flexibility in heating the sheets S of various sizes.

A width of the A3 size sheet in portrait orientation and a width of the A4 size sheet in landscape orientation are smaller than a width of the A3 extension size sheet in portrait orientation (e.g., 329 mm) and a width of the 13-inch sheet in portrait orientation (e.g., 330 mm) by a differential in a range of from 32 mm to 33 mm, respectively. Accordingly, if the fixing device 150 is configured to heat each lateral end span of the fixing belt 14 in the axial direction thereof, that is, if the fixing device 150 is configured to heat a half of the differential in the range of from 32 mm to 33 mm, that is, a span in a range of from 16.0 mm to 16.5 mm, the maximum width of sheets S available in the fixing device 150 increases from the width W1 of the A3 size sheet to the width W2 of the A3 extension size sheet or the like as shown in FIG. 14. In other words, if the fixing device 150 is configured to heat each outboard span, that is, each lateral end span, of the fixing belt 14 disposed opposite each outboard span of the halogen heater 28*b* that is outboard from each lateral end span of the halogen heater 28*b* in the axial direction of the fixing belt 14 and does not have the dense light distribution, where the halogen heater 28*b* is susceptible to temperature decrease, the fixing belt 14 is heated in an increased span in the axial direction thereof like when the fixing belt 14 is heated by the elongated halogen heater 28*b*E depicted in FIG. 12. Thus, the large sheet S (e.g., the A3 extension size sheet) is available in the fixing device 150.

As the large sheet S (e.g., the A3 extension size sheet and the 13-inch sheet) is conveyed through the fixing nip N, the halogen heaters 28*a* and 28*b* and the lateral end heaters 24*a* and 24*b* are energized. Conversely, as the small sheet S (e.g., a sheet not greater than the A3 size sheet) is conveyed through the fixing nip N, the halogen heaters 28*a* and 28*b* are energized or the halogen heater 28*a* is energized. Hence, the lateral end heaters 24*a* and 24*b* are not energized.

If the halogen heater 28*b* is configured to have an increased heating span to heat the large sheet S such as the A3 extension size sheet, the halogen heater 28*b* may heat the outboard span E of the fixing belt 14 unnecessarily while the large sheet S is not conveyed through the fixing nip N, wasting energy. To address this circumstance, the fixing device 150 according to this exemplary embodiment incorporates a simple mechanism in addition to the halogen heaters 28*a* and 28*b*, that is, the lateral end heaters 24*a* and 24*b* being disposed within the circumferential fixing nip span of the fixing nip N in the circumferential direction of the fixing belt 14 and disposed opposite both lateral end spans G in the axial direction of the fixing belt 14 or in proximity to both lateral ends of the fixing belt 14 in the axial direction thereof, respectively.

Since the lateral end heaters 24*a* and 24*b* are configured to heat the fixing belt 14 locally in a restricted axial span thereof, that is, in both lateral end spans G of the fixing belt 14 in the axial direction thereof, it is difficult to adjust the temperature of the fixing belt 14 with the lateral end heaters 24*a* and 24*b* to even the temperature of the fixing belt 14 in the axial direction thereof. For example, with the lateral end heaters 24*a* and 24*b* only that heat the fixing belt 14 locally, the fixing belt 14 does not attain an even temperature throughout the entire span in the axial direction thereof, resulting in variation in fixing of the toner image on the sheet S. To address this circumstance, the supplementary thermal conductor 25 having an increased thermal conductivity evens the temperature of the entire fixing belt 14.

A detailed description is now given of a configuration of the supplementary thermal conductor 25.

Heat generated by the lateral end heaters 24*a* and 24*b* is conducted to the entire fixing belt 14 through the supplementary thermal conductor 25. Thus, the supplementary thermal conductor 25 facilitates equalization of the temperature or the temperature inclination of the entire fixing belt 14. Additionally, the increased thermal conductivity of the supplementary thermal conductor 25 suppresses temperature decrease in the outboard span of the halogen heater 28*b* caused by the property peculiar to the halogen heaters.

Figure 15A:
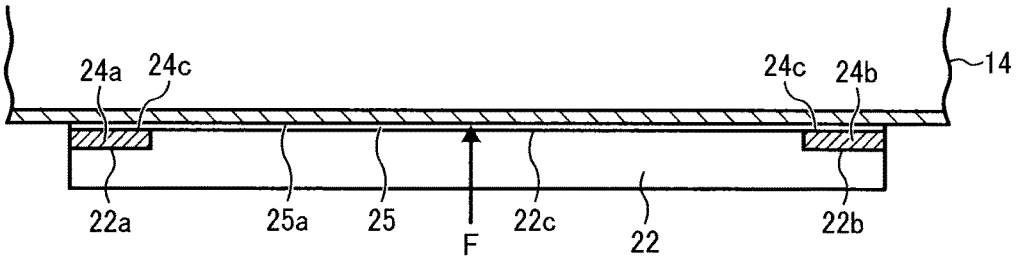
FIG. 15A is a sectional view of the fixing belt, a nip formation pad, and the lateral end heaters incorporated in the fixing device shown in FIG. 2 according to an exemplary embodiment of the present disclosure.

FIG. 15A is a sectional view of the fixing belt 14, the nip formation pad 22, the lateral end heaters 24*a* and 24*b*, and the supplementary thermal conductor 25. As shown in FIG. 15A, each of the lateral end heaters 24*a* and 24*b* includes the fixing belt side face 24*c* disposed opposite the inner circumferential surface of the fixing belt 14. The nip formation pad 22 includes the nip formation face 22*c* disposed opposite the inner circumferential surface of the fixing belt 14. The fixing belt side face 24*c* of the respective lateral end heaters 24*a* and 24*b* is leveled with the nip formation face 22*c* of the nip formation pad 22 in a pressurization direction F (e.g., a direction of a reaction force against pressure from the pressure roller 16) in which the nip formation pad 22 presses against the inner circumferential surface of the fixing belt 14. In other words, the fixing belt side face 24*c* disposed opposite the inner circumferential surface of the fixing belt 14 defines an extension of the nip formation face 22*c* in the longitudinal direction of the nip formation pad 22. The fixing belt side face 24*c* and the nip formation face 22*c* define an identical plane.

Since the fixing belt side face 24*c* adheres to the supplementary thermal conductor 25, heat generated by the lateral end heaters 24*a* and 24*b* is conducted to the entire fixing belt 14 through the supplementary thermal conductor 25. The increased thermal conductivity of the supplementary thermal conductor 25 heats the inner circumferential surface of the fixing belt 14 smoothly and evenly in an axial span of the fixing belt 14 greater than a combined heating span of the halogen heaters 28*a* and 28*b* and the lateral end heaters 24*a* and 24*b* in the axial direction of the fixing belt 14. Accordingly, the lateral end heaters 24*a* and 24*b* do not overheat the fixing belt 14 locally. Instead, the lateral end heaters 24*a* and 24*b* heat the fixing belt 14 in the increased axial span gently, improving adjustment of the temperature of the fixing belt 14.

Figure 15B:
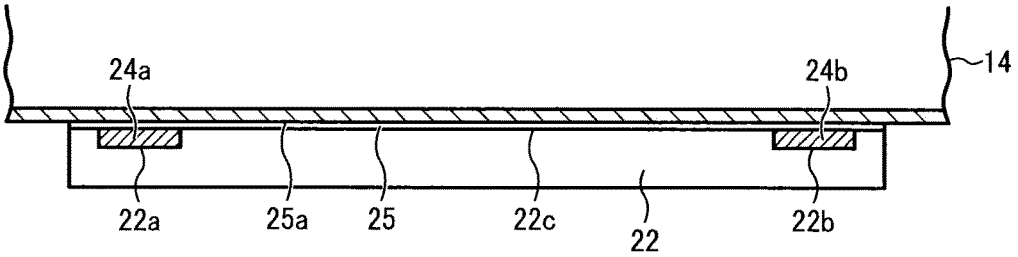
FIG. 15B is a sectional view of the fixing belt, the nip formation pad, and the lateral end heaters as a first variation of the exemplary embodiment shown in FIG. 15A.

As shown in FIG. 15A, the nip formation pad 22 includes the recesses 22*a* and 22*b* that accommodate the lateral end heaters 24*a* and 24*b*, respectively. Each of the recesses 22*a* and 22*b* is open at each lateral edge of the nip formation pad 22 in the longitudinal direction thereof. Alternatively, each of the recesses 22*a* and 22*b* may be closed and formed in a box defined by a bottom and four walls as shown in FIG. 15B. FIG. 15B is a sectional view of the fixing belt 14, the nip formation pad 22, and the lateral end heaters 24*a* and 24*b* illustrating the closed recesses 22*a* and 22*b*. Alternatively, each of the recesses 22*a* and 22*b* may be closed at both ends in the axial direction of the fixing belt 14 and open at both ends in a direction perpendicular to the axial direction of the fixing belt 14.

Figure 16A:
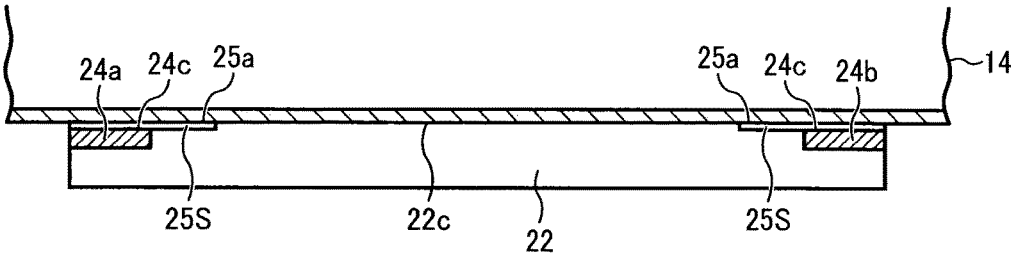
FIG. 16A is a sectional view of the nip formation pad and the lateral end heaters as a second variation of the exemplary embodiment shown in FIG. 15A.
Figure 16B:
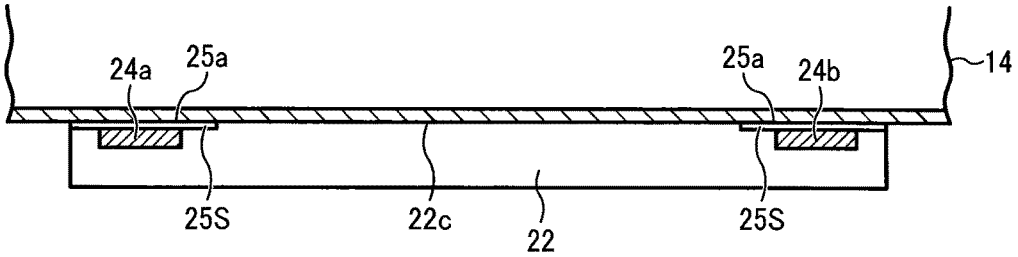
FIG. 16B is a sectional view of the fixing belt, the nip formation pad, and the lateral end heaters as a third variation of the exemplary embodiment shown in FIG. 15A.

FIG. 16A is a sectional view of the fixing belt 14, the nip formation pad 22, the lateral end heaters 24*a* and 24*b*, and supplementary thermal conductors 25S illustrating the supplementary thermal conductors 25S disposed opposite the lateral end heaters 24*a* and 24*b* shown in FIG. 15A. FIG. 16B is a sectional view of the fixing belt 14, the nip formation pad 22, the lateral end heaters 24*a* and 24*b*, and the supplementary thermal conductors 25S illustrating the supplementary thermal conductors 25S disposed opposite the lateral end heaters 24*a* and 24*b* shown in FIG. 15B.

The supplementary thermal conductor 25 depicted in FIGS. 15A and 15B extends throughout the entire width of the nip formation pad 22 in the longitudinal direction thereof. Conversely, as shown in FIGS. 16A and 16B, the supplementary thermal conductors 25S are disposed opposite the lateral end heaters 24*a* and 24*b*, respectively, to cover the fixing belt side face 24*c* of the respective lateral end heaters 24*a* and 24*b*. The supplementary thermal conductors 25S are greater than the lateral end heaters 24*a* and 24*b* in the axial direction of the fixing belt 14, respectively, to cover the fixing belt side face 24*c* and the vicinity of the fixing belt side face 24*c*.

As shown in FIGS. 15A, 15B, 16A, and 16B, each of the supplementary thermal conductors 25 and 25S includes the contact face 25*a* disposed opposite the inner circumferential surface of the fixing belt 14. As shown in FIGS. 16A and 16B, the contact face 25*a* of the supplementary thermal conductor 25S is substantially leveled with the nip formation face 22*c* of the nip formation pad 22 in the pressurization direction F.

The nip formation face 22*c* and the contact face 25*a* disposed opposite the inner circumferential surface of the fixing belt 14 constitute a smooth nip formation face that forms the fixing nip N. The nip formation face 22*c* and the contact face 25*a* are subject to treatment that reduces the friction coefficient to facilitate sliding of the fixing belt 14 over the nip formation face 22*c* and the contact face 25*a*. For example, the nip formation face 22*c* and the contact face 25*a* are coated with a fluorine material such as PFA and PTFE or treated with coating.

According to this exemplary embodiment, the lateral end heaters 24*a* and 24*b* are coupled with the nip formation pad 22 to form the fixing nip N. Hence, the lateral end heaters 24*a* and 24*b* are situated in a limited space inside the loop formed by the fixing belt 14, saving space.

The fixing belt side face 24*c* of the respective lateral end heaters 24*a* and 24*b* that is disposed opposite the inner circumferential surface of the fixing belt 14 is leveled with the nip formation face 22*c* of the nip formation pad 22 that is disposed opposite the inner circumferential surface of the fixing belt 14 in the pressurization direction F to define an identical plane. Accordingly, the pressure roller 16 is pressed against the lateral end heaters 24*a* and 24*b* via the fixing belt 14 and the supplementary thermal conductor 25 or 25S sufficiently. Consequently, the fixing belt 14 rotates in a state in which the fixing belt 14 adheres to the lateral end heaters 24*a* and 24*b* indirectly via the supplementary thermal conductor 25 or 25S, improving conduction of heat from the lateral end heaters 24*a* and 24*b* to the fixing belt 14 and thereby retaining improved heating efficiency of the lateral end heaters 24*a* and 24*b*. Since the lateral end heaters 24*a* and 24*b* are situated within an axial fixing nip span of the fixing nip N in the axial direction of the fixing belt 14 to heat the fixing belt 14, the lateral end heaters 24*a* and 24*b* do not heat a portion of the fixing belt 14 that is outboard from the fixing nip N in the axial direction of the fixing belt 14, preventing residual toner failed to be fixed on the sheet S and therefore remaining on the fixing belt 14 from being melted again and adhered to the fixing belt 14.

The pressure roller 16 also serves as a biasing member that presses the fixing belt 14 against the lateral end heaters 24*a* and 24*b* to adhere the fixing belt 14 to the lateral end heaters 24*a* and 24*b* so as to enhance conduction of heat from the lateral end heaters 24*a* and 24*b* to the fixing belt 14. Accordingly, a mechanism that presses the lateral end heaters 24*a* and 24*b* against the fixing belt 14 is not needed, simplifying the fixing device 150. In other words, pressure used to form the fixing nip N is also used to adhere the fixing belt 14 to the lateral end heaters 24*a* and 24*b*, improving conduction of heat from the lateral end heaters 24*a* and 24*b* to the fixing belt 14 without degrading rotation of the fixing belt 14.

The lateral end heaters 24*a* and 24*b* may have a positive temperature coefficient (PTC) property. If the lateral end heaters 24*a* and 24*b* have the PTC property, a resistance value increases at a preset temperature or higher and therefore the lateral end heaters 24*a* and 24*b* do not generate heat at the preset temperature or higher. Hence, the lateral end heaters 24*a* and 24*b* do not burn or damage the fixing belt 14, achieving the safe fixing device 150. Additionally, the lateral end heaters 24*a* and 24*b* situated inside the loop formed by the fixing belt 14 emit light that irradiates the inner circumferential surface of the fixing belt 14 to heat both lateral end spans G of the fixing belt 14 in the axial direction thereof without degrading rotation of the fixing belt 14.

If a portion of the respective lateral end heaters 24*a* and 24*b* that contacts the inner circumferential surface of the fixing belt 14 is made of a smooth material different from a material of a body of the respective lateral end heaters 24*a* and 24*b*, the smooth material suppresses the sliding friction of the fixing belt 14 as the fixing belt 14 slides over the lateral end heaters 24*a* and 24*b*, retaining stable rotation of the fixing belt 14.

According to the exemplary embodiments described above, the nip formation assembly 18 (e.g., a nip formation unit) disposed inside the loop formed by the fixing belt 14 includes the nip formation pad 22 and the halogen heaters 28*a* and 28*b* disposed opposite at least the conveyance span, that is, the center span, of the fixing belt 14 in the axial direction thereof where the sheet S is conveyed to heat at least the center span of the fixing belt 14. The nip formation pad 22 mounts the lateral end heaters 24*a* and 24*b* disposed opposite the inner circumferential surface of the fixing belt 14 at both lateral ends of the fixing belt 14 in the axial direction thereof, respectively.

Since the lateral end heaters 24*a* and 24*b* are disposed opposite the fixing nip N where the fixing belt 14 is exerted with pressure from the pressure roller 16, the fixing belt 14 is exerted with pressure at a single spot, that is, the fixing nip N. Accordingly, the nip formation assembly 18 reduces faulty rotation or motion of the fixing belt 14. Consequently, the fixing device 150 and the image forming apparatus 100 incorporating the fixing device 150 perform improved image forming operation constantly.

The lateral end heaters 24*a* and 24*b* having the PTC property may take an extended period of time to achieve a predetermined target temperature compared to the halogen heaters 28*a* and 28*b*. For example, if the lateral end heaters 24*a* and 24*b* and the halogen heaters 28*a* and 28*b* are energized simultaneously, the center span of the fixing belt 14 in the axial direction thereof may be heated quickly, wasting energy. Further, as the sheets S conveyed over the fixing belt 14 draw heat from the fixing belt 14, the lateral end heaters 24*a* and 24*b*, due to their PTC property, may take the extended period of time to retrieve the predetermined target temperature compared to the halogen heaters 28*a* and 28*b*.

To address this circumstance, the fixing device 150 decreases productivity to correspond to a heating cycle of the lateral end heaters 24*a* and 24*b*, thus controlling heating of the fixing belt 14 to reduce variation in temperature of the fixing belt 14 in the axial direction thereof, that is, between the center span and each lateral end span of the fixing belt 14 in the axial direction thereof.

For example, while the lateral end heaters 24*a* and 24*b* that heat both lateral end spans G of the fixing belt 14 in the axial direction thereof or the vicinity of both lateral ends of the fixing belt 14, respectively, where the A3 extension size sheet is conveyed are energized, actuation of the halogen heaters 28*a* and 28*b* that heat an inboard span inboard from both lateral end spans G of the fixing belt 14 in the axial direction thereof where sheets S smaller than the A3 extension size sheet are conveyed is controlled in accordance with temperature increase of both lateral end spans G of the fixing belt 14 in the axial direction thereof. Accordingly, the fixing device 150 prevents waste of energy caused by the halogen heaters 28*a* and 28*b* that heat the inboard span of the fixing belt 14 in the axial direction thereof where the sheets S smaller than the large sheet S are conveyed quickly and unnecessarily while the lateral end heaters 24*a* and 24*b* generate a decreased amount of heat.

A conveyance speed at which the A3 extension size sheet heated by the lateral end heaters 24*a* and 24*b* is conveyed is smaller than a conveyance speed at which the sheets S other than the A3 extension size sheet are conveyed. Thus, the fixing device 150 decreases productivity when the infrequently used, large sheet S (e.g., the A3 extension size sheet) is conveyed, simplifying the lateral end heaters 24*a* and 24*b* that heat both lateral end spans G of the fixing belt 14 in the axial direction thereof, respectively, and reducing manufacturing costs. Consequently, the fixing belt 14 is heated effectively.

According to the exemplary embodiments described above, the fixing device 150 includes the two halogen heaters 28*a* and 28*b* serving as fixing heaters, respectively. Alternatively, the fixing device 150 may include three or more halogen heaters to correspond to various sizes of small sheets S.

The lateral end heaters 24*a* and 24*b* may be controlled based on the temperature of the fixing belt 14 detected by a temperature sensor 27 used to control the halogen heaters 28*a* and 28*b*. As shown in FIG. 2, the temperature sensor 27 serving as a temperature detector is disposed opposite the outer circumferential surface of the fixing belt 14 to detect the temperature of the fixing belt 14. A controller 90, operatively connected to the temperature sensor 27, the halogen heaters 28*a* and 28*b*, and the lateral end heaters 24*a* and 24*b*, controls the halogen heaters 28*a* and 28*b* and the lateral end heaters 24*a* and 24*b* based on the temperature of the fixing belt 14 detected by the temperature sensor 27. For example, the controller 90 is a processor, that is, a central processing unit (CPU) provided with a random-access memory (RAM) and a read-only memory (ROM). In this case, the fixing device 150 does not incorporate an extra temperature sensor configured to detect the temperature of the fixing belt 14 to control the lateral end heaters 24*a* and 24*b*, reducing manufacturing costs.

A description is provided of a construction of a nip formation assembly 63 (e.g., a nip formation unit) as a variation of the nip formation assembly 18 depicted in FIG. 2.

Figure 17:
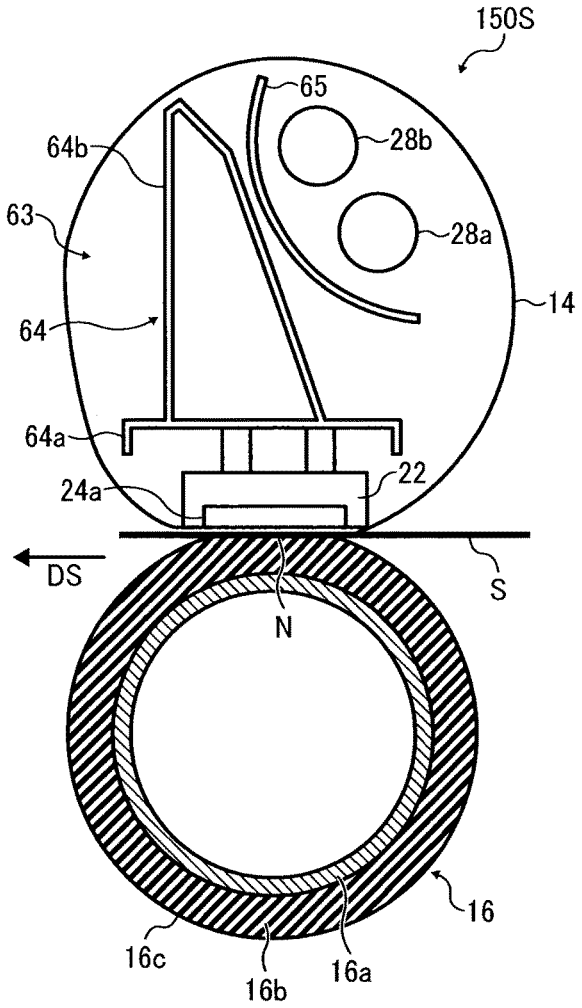
FIG. 17 is a schematic vertical sectional view of a fixing device incorporating a variation of the nip formation assembly shown in FIG. 6.

FIG. 17 is a schematic vertical sectional view of a fixing device 150S (a fuser or a fusing unit) incorporating the nip formation assembly 63. As shown in FIG. 17, the nip formation assembly 63 includes the nip formation pad 22, the lateral end heaters 24*a* and 24*b*, and a stay 64 that supports the nip formation pad 22 against pressure from the pressure roller 16.

The stay 64 includes a base 64*a* and a stand 64*b* coupled with the base 64*a*. The base 64*a* supports the nip formation pad 22 like the stay 26 depicted in FIG. 2. The stand 64*b* is substantially contoured into a triangle in cross-section. The halogen heaters 28*a* and 28*b* serving as a fixing heater or a fixing heat source are interposed between the stand 64*b* of the stay 64 and the fixing belt 14. The halogen heaters 28*a* and 28*b* heat the fixing belt 14 directly with light irradiating the inner circumferential surface of the fixing belt 14, thus heating the fixing belt 14 with radiation heat.

An arcuate, platy reflector 65 is interposed between the halogen heaters 28*a* and 28*b* and the stand 64*b* of the stay 64 to reflect light radiated from the halogen heaters 28*a* and 28*b* toward the fixing belt 14 so as to improve heating efficiency of the halogen heaters 28*a* and 28*b* to heat the fixing belt 14.

The nip formation assembly 63 achieves advantages similar to those of the nip formation assembly 18 described above. Alternatively, instead of the reflector 65, an exterior surface of the stand 64*b* may be treated with insulation or mirror finish to reflect light radiated from the halogen heaters 28*a* and 28*b* toward the fixing belt 14. In this case, the halogen heaters 28*a* and 28*b* heat the fixing belt 14 with a slightly decreased heating efficiency compared to a heating efficiency with which the halogen heaters 28*a* and 28*b* heat the fixing belt 14 together with the reflector 65.

A detailed description is now given of a construction of the fixing belt 14 made of metal.

The fixing belt 14 shown in FIGS. 2, 3, 8, and 17 conducts heat received from the halogen heaters 28*a* and 28*b* to the fixing nip N as the fixing belt 14 rotates in accordance with rotation of the pressure roller 16 contacting the outer circumferential surface of the fixing belt 14. Since the fixing belt 14 is exerted with a substantial load, the fixing belt 14 may have an insufficient mechanical strength if the fixing belt 14 is made of resin such as polyimide. To address this circumstance, the fixing belt 14 includes the base layer made of metal that achieves a sufficient mechanical strength, such as stainless steel, nickel, aluminum, and copper.

Figure 18:
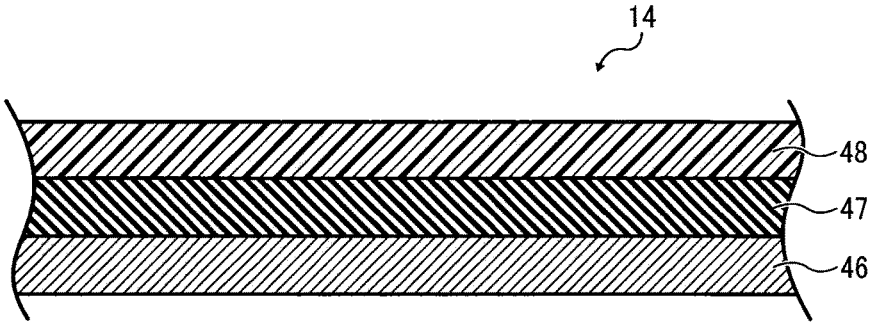
FIG. 18 is a sectional view of the fixing belt incorporated in the fixing device shown in FIG. 2.

FIG. 18 is a sectional view of the fixing belt 14. As shown in FIG. 18 illustrating an example of a construction of the fixing belt 14, the fixing belt 14 includes a base layer 46 made of metal, an elastic layer 47 coating an outer circumferential surface of the base layer 46, and a release layer 48 coating an outer circumferential surface of the elastic layer 47. The base layer 46, the elastic layer 47, and the release layer 48 are layered by a typical method.

The base layer 46 is requested to cause the fixing belt 14 to achieve durability, flexibility, and heat resistance to endure usage at the fixing temperature. The elastic layer 47 and the release layer 48 are also produced to achieve those durability, flexibility, and heat resistance.

Nickel is more appropriate than stainless steel for the base layer 46 of the fixing belt 14 because nickel is superior to stainless steel in mechanical strength, durability, and readiness in manufacturing of the endless fixing belt 14 by an electroforming process.

With reference to FIGS. 19, 20A, 20B, 20C, 21, 22A, 22B, 22C, and 23, a description is provided of an electric connection between the halogen heaters 28*a* and 28*b* and the lateral end heaters 24*a* and 24*b*.

Figure 19:
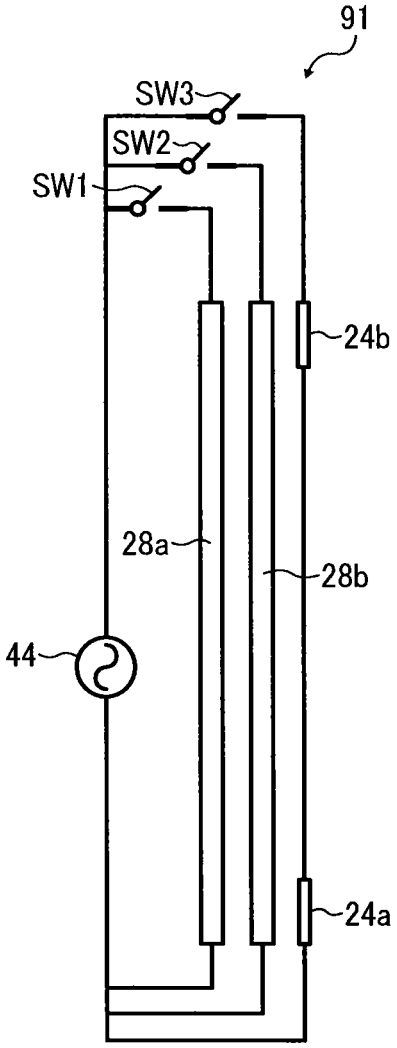
FIG. 19 is a diagram of an electric circuit showing an electric connection between the halogen heaters and the lateral end heaters shown in FIGS. 9 and 14.

FIG. 19 is a diagram of an electric circuit 91 showing the electric connection between the halogen heaters 28*a* and 28*b* and the lateral end heaters 24*a* and 24*b*. Under a center conveyance system in which the sheet S is centered in the axial direction of the fixing belt 14 as the sheet S is conveyed over the fixing belt 14, the lateral end heaters 24*a* and 24*b* are energized simultaneously. Accordingly, the lateral end heaters 24*a* and 24*b* are electrically connected in series to a power supply 44 as shown in FIG. 19. Consequently, the lateral end heaters 24*a* and 24*b* are electrically controlled more simply compared to a control in which the lateral end heater 24*a* is powered on and off separately from the lateral end heater 24*b*.

If one of the lateral end heaters 24*a* and 24*b* suffers from failure, the power supply 44 interrupts power supply to the lateral end heaters 24*a* and 24*b* simultaneously, achieving safety of the fixing device 150. The power supply 44 powers on and off the halogen heater 28*a* through a switch SW1, the halogen heater 28*b* through a switch SW2, and the lateral end heaters 24*a* and 24*b* through a switch SW3.

Figure 20A:
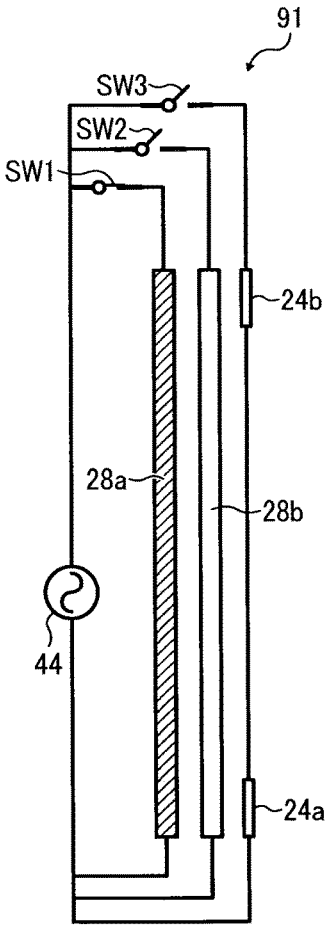
FIG. 20A is a diagram of the electric circuit shown in FIG. 19 illustrating a first energization pattern.

FIG. 20A is a diagram of the electric circuit 91 illustrating a first energization pattern. As shown in FIG. 20A, as a small sheet S smaller than the A3 size sheet is conveyed through the fixing nip N, the halogen heater 28*a* is energized.

Figure 20B:
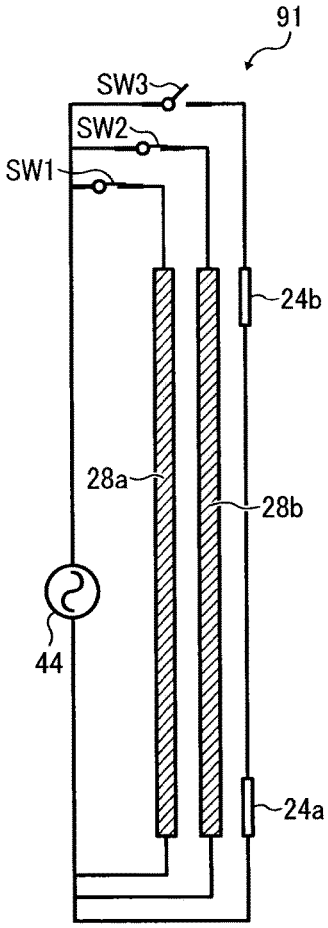
FIG. 20B is a diagram of the electric circuit shown in FIG. 19 illustrating a second energization pattern.

FIG. 20B is a diagram of the electric circuit 91 illustrating a second energization pattern. As shown in FIG. 20B, as the A3 size sheet is conveyed through the fixing nip N, the halogen heaters 28*a* and 28*b* are energized.

Figure 20C:
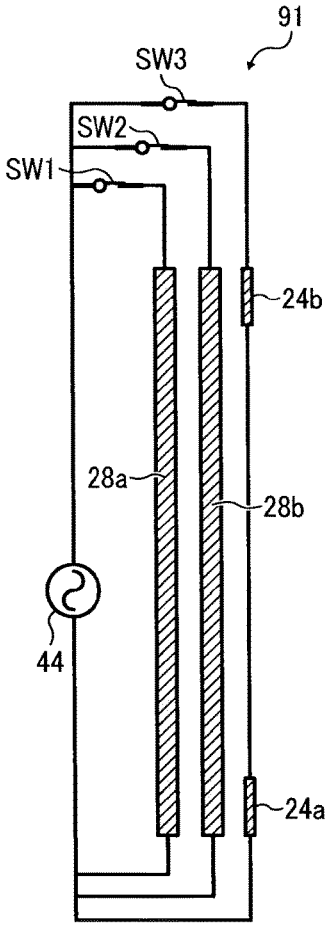
FIG. 20C is a diagram of the electric circuit shown in FIG. 19 illustrating a third energization pattern.

FIG. 20C is a diagram of the electric circuit 91 illustrating a third energization pattern. As shown in FIG. 20C, as a large sheet S greater than the A3 size sheet is conveyed through the fixing nip N, the halogen heaters 28*a* and 28*b* and the lateral end heaters 24*a* and 24*b* are energized simultaneously.

As shown in FIG. 2, the halogen heaters 28*a* and 28*b*, disposed opposite the fixing nip N via the stay 26 to heat a non-nip side portion of the fixing belt 14 that is opposite the fixing nip N, are energized separately from the lateral end heaters 24*a* and 24*b* disposed opposite the fixing nip N to heat a nip side portion of the fixing belt 14 that constitutes the fixing nip N. Accordingly, the electric circuit 91 precisely controls the lateral end heaters 24*a* and 24*b* to heat both lateral end spans G of the fixing belt 14 in the axial direction thereof, respectively. Additionally, the electric circuit 91 prevents overheating or temperature increase of the non-conveyance span of the fixing belt 14 in the axial direction thereof where the sheet S is not conveyed.

The lateral end heaters 24*a* and 24*b* are energized as the large sheet S greater than the A3 size sheet is conveyed through the fixing nip N. The halogen heater 28*b* directed to heat each lateral end span of the fixing belt 14 in the axial direction thereof is energized simultaneously.

Figure 21:
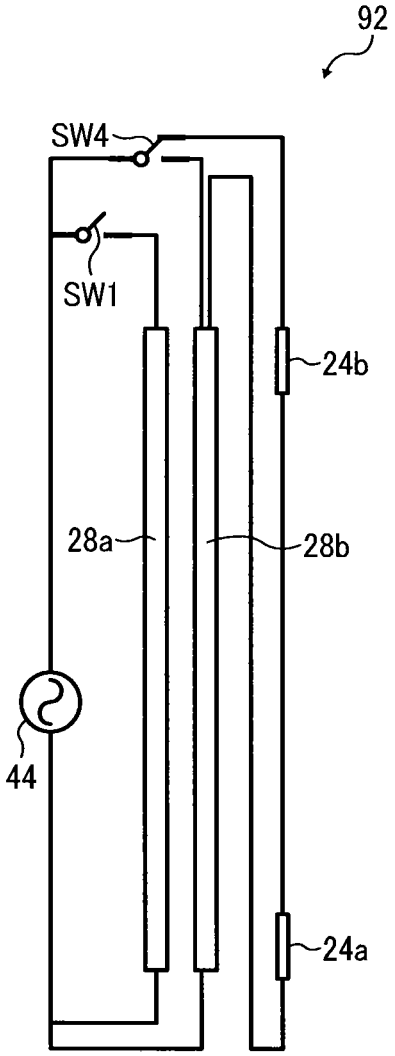
FIG. 21 is a diagram of an electric circuit as a first variation of the electric circuit shown in FIG. 19.

FIG. 21 is a diagram of an electric circuit 92 as another variation of the electric circuit 91 shown in FIG. 19. As shown in FIG. 21, the halogen heater 28*b* is connected in series to the lateral end heaters 24*a* and 24*b*. Power supply to the halogen heaters 28*a* and 28*b* and the lateral end heaters 24*a* and 24*b* is controlled by switching a path with the switch SW1 and a switch SW4 so as to attain advantages similar to the advantages described above. Accordingly, the controller 90 to control power supply to the halogen heaters 28*a* and 28*b* and the lateral end heaters 24*a* and 24*b* is simplified. Since a temperature property of the halogen heater 28*b* is different from that of the lateral end heaters 24*a* and 24*b*, the temperature of the halogen heater 28*b* and the lateral end heaters 24*a* and 24*b* is adjusted by switching the path.

Figure 22C:
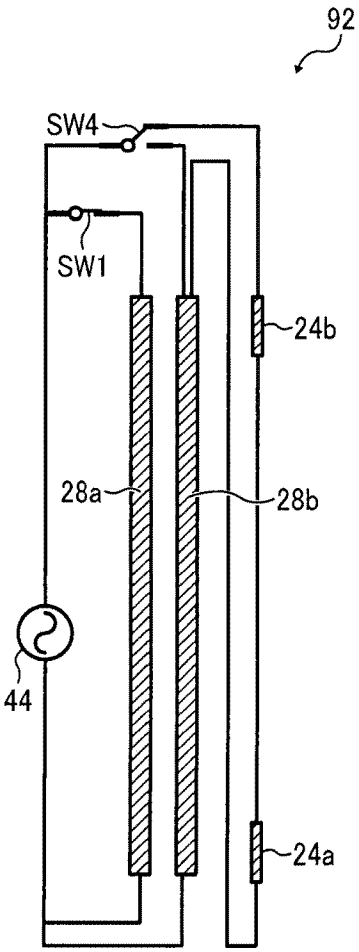
FIG. 22C is a diagram of the electric circuit shown in FIG. 21 illustrating a third energization pattern.
Figure 22B:
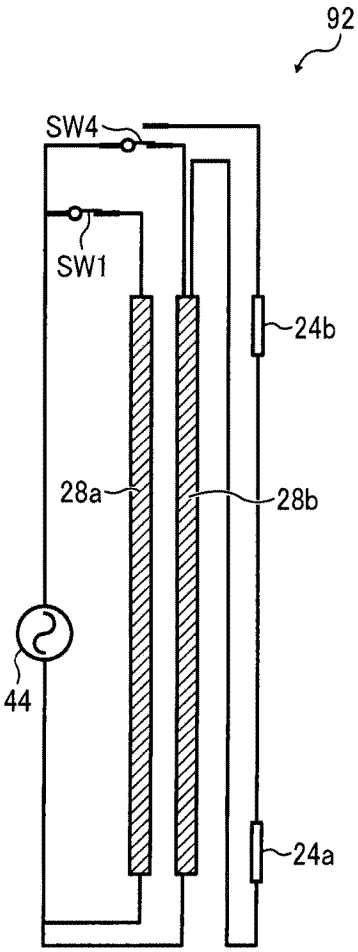
FIG. 22B is a diagram of the electric circuit shown in FIG. 21 illustrating a second energization pattern.
Figure 22A:
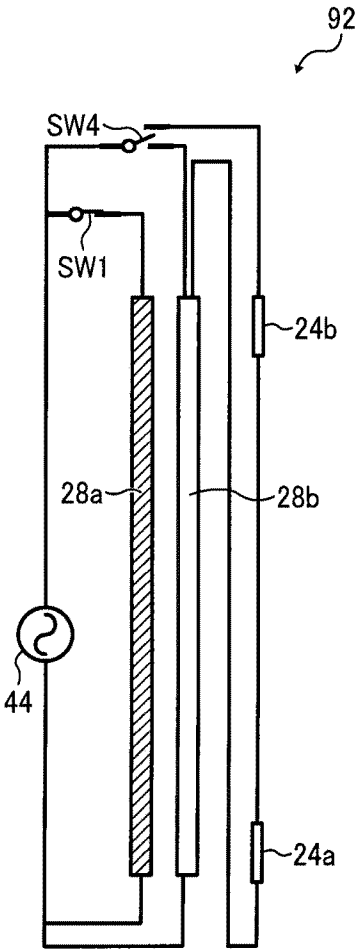
FIG. 22A is a diagram of the electric circuit shown in FIG. 21 illustrating a first energization pattern.

FIG. 22A is a diagram of the electric circuit 92 illustrating a first energization pattern. As shown in FIG. 22A, as a small sheet S smaller than the A3 size sheet is conveyed through the fixing nip N, the halogen heater 28*a* is energized. The switch SW4 is isolated from a terminal of the halogen heater 28*b* and a terminal of the lateral end heaters 24*a* and 24*b*.

FIG. 22B is a diagram of the electric circuit 92 illustrating a second energization pattern. As shown in FIG. 22B, as the A3 size sheet is conveyed through the fixing nip N, the halogen heaters 28*a* and 28*b* are energized.

FIG. 22C is a diagram of the electric circuit 92 illustrating a third energization pattern. As shown in FIG. 22C, as a large sheet S greater than the A3 size sheet is conveyed through the fixing nip N, the halogen heaters 28*a* and 28*b* and the lateral end heaters 24*a* and 24*b* are energized simultaneously.

FIGS. 19 and 21 illustrate the electric circuits 91 and 92 having an electric wiring that connects the halogen heater 28*b* to the lateral end heaters 24*a* and 24*b* in series. However, when the large sheet S is conveyed through the fixing nip N, the halogen heater 28*a* is also energized simultaneously. Accordingly, the electric wiring that connects the halogen heater 28*a* to the lateral end heaters 24*a* and 24*b* in series attains the similar advantages.

Figure 23:
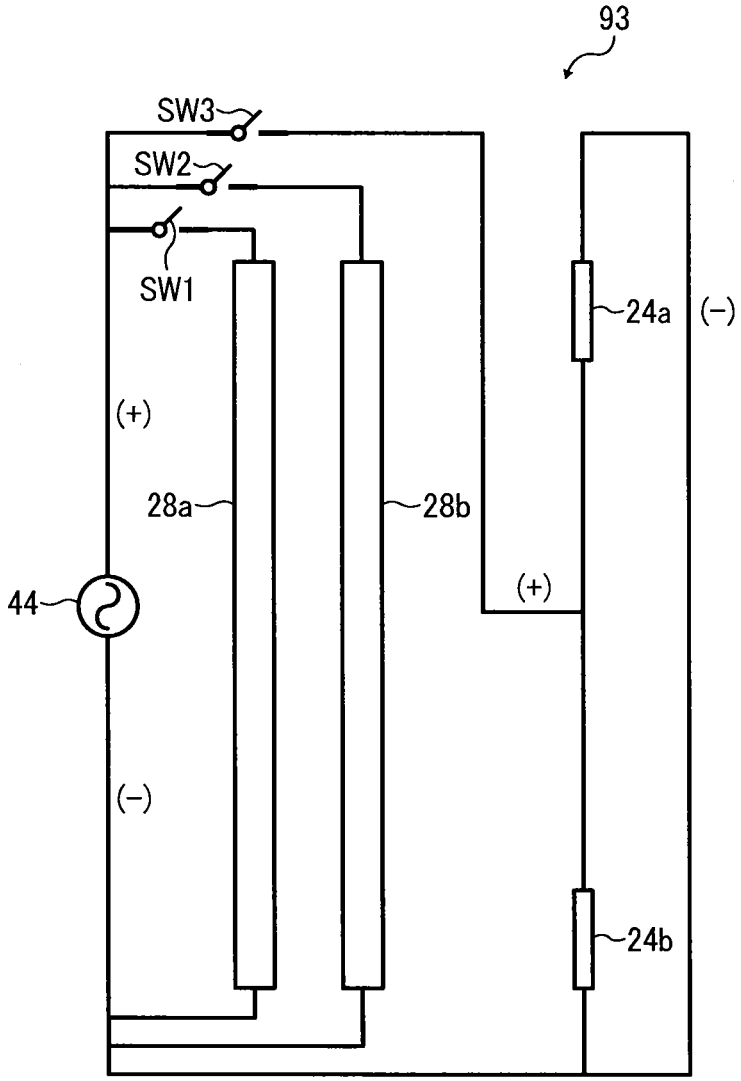
FIG. 23 is a diagram of an electric circuit as a second variation of the electric circuit shown in FIG. 19.

FIG. 23 is a diagram of an electric circuit 93 as a second variation of the electric circuit 91 shown in FIG. 19 illustrating an electric connection between the halogen heaters 28*a* and 28*b* and the lateral end heaters 24*a* and 24*b*. As shown in FIG. 23, the lateral end heaters 24*a* and 24*b* are connected in parallel to the halogen heater 28*b*.

When the switch SW3 is turned off, the lateral end heaters 24*a* and 24*b* are connected to a negative electrode. Hence, no electric current flows in the lateral end heaters 24*a* and 24*b*. Conversely, when the switch SW3 is turned on, the lateral end heaters 24*a* and 24*b* are connected to a positive electrode. Accordingly, an electric current from the power supply 44 flows in each of the lateral end heaters 24*a* and 24*b*, causing the lateral end heaters 24*a* and 24*b* to generate heat.

Accordingly, if one of the lateral end heaters 24*a* and 24*b* suffers from short circuit, a fuse prevents the lateral end heaters 24*a* and 24*b* from being out of control by overflow of the electric current, improving safety.

The present disclosure is not limited to the details of the exemplary embodiments described above and various modifications and improvements are possible. The advantages achieved by the fixing device 150 are not limited to those described above.

A description is provided of advantages of the fixing device 150.

As shown in FIG. 2, the fixing device 150 includes the flexible, tubular endless fixing belt 14 serving as an endless belt or a fixing rotator formed into a loop and rotatable in a predetermined direction of rotation (e.g., the rotation direction D14); the pressure roller 16 serving as an opposed rotator disposed outside the loop formed by the fixing belt 14 and disposed opposite the fixing belt 14; a fixing heater (e.g., the halogen heaters 28*a* and 28*b*) disposed opposite at least the conveyance span (e.g., the center span) of the fixing belt 14 in the axial direction thereof where a sheet S serving as a recording medium is conveyed to heat the fixing belt 14; and the nip formation pad 22 disposed inside the loop formed by the fixing belt 14 to press against the pressure roller 16 via the fixing belt 14 to form the fixing nip N between the fixing belt 14 and the pressure roller 16. As a sheet S bearing a toner image is conveyed through the fixing nip N, the fixing belt 14 and the pressure roller 16 fix the toner image on the sheet S. As shown in FIGS. 9 and 14, the fixing device 150 further includes a lateral end heater (e.g., the lateral end heaters 24*a* and 24*b*) mounted on the nip formation pad 22 and disposed opposite the inner circumferential surface of the fixing belt 14 in the lateral end span G of the fixing belt 14 in the axial direction thereof to heat the fixing belt 14. As shown in FIGS. 15A, 15B, 16A, and 16B, the fixing device 150 further includes the supplementary thermal conductor 25 contacting the lateral end heater and the fixing belt 14 to conduct heat conducted from the lateral end heater to the fixing belt 14.

Accordingly, the lateral end heater heats the fixing belt 14 effectively while retaining stable rotation of the fixing belt 14. Consequently, the lateral end heater prevents residual toner failed to be fixed on the sheet S and therefore remaining on the fixing belt 14 from being melted again and adhered to the fixing belt 14.

Additionally, since the lateral end heater is mounted on the nip formation pad 22 disposed at the fixing nip N where the fixing belt 14 receives pressure from the pressure roller 16, the fixing belt 14 is exerted with pressure at a single spot, that is, the fixing nip N, thus reducing faulty rotation or motion of the fixing belt 14.

As shown in FIGS. 6, 9, 14, 15A, 15B, 16A, and 16B, the lateral end heaters 24*a* and 24*b* are disposed opposite both lateral end spans G of the fixing belt 14 in the axial direction thereof, respectively, because the fixing device 150 employs the center conveyance system in which the sheet S is centered on the fixing belt 14 in the axial direction thereof. Alternatively, one of the lateral end heaters 24*a* and 24*b* may be eliminated if the fixing device 150 employs a lateral edge conveyance system in which the sheet S is conveyed in the sheet conveyance direction DS along one lateral edge of the fixing belt 14 in the axial direction thereof. In this case, another one of the lateral end heaters 24*a* and 24*b* is distal from the lateral edge of the fixing belt 14 in the axial direction thereof.

According to the exemplary embodiments described above, the fixing belt 14 serves as a fixing rotator. Alternatively, a fixing film, a fixing sleeve, or the like may be used as a fixing rotator. Further, the pressure roller 16 serves as an opposed rotator. Alternatively, a pressure belt or the like may be used as an opposed rotator.

The present disclosure has been described above with reference to specific exemplary embodiments. Note that the present disclosure is not limited to the details of the embodiments described above, but various modifications and enhancements are possible without departing from the spirit and scope of the disclosure. It is therefore to be understood that the present disclosure may be practiced otherwise than as specifically described herein. For example, elements and/or features of different illustrative exemplary embodiments may be combined with each other and/or substituted for each other within the scope of the present disclosure.

What is claimed is:

1. A fixing device comprising:

a fixing rotator, which is flexible and tubular, the flexible, tubular fixing rotator being rotatable in a predetermined direction of rotation;

an opposed rotator disposed opposite the flexible, tubular fixing rotator;

a nip formation pad to press against the opposed rotator via the flexible, tubular fixing rotator to form a fixing nip between the flexible, tubular fixing rotator and the opposed rotator, the fixing nip through which a recording medium bearing a toner image is conveyed;

a fixing heater disposed opposite at least a conveyance span of the flexible, tubular fixing rotator in an axial direction thereof where the recording medium is conveyed to be heated by the flexible, tubular fixing rotator;

a lateral end heater mounted on the nip formation pad and disposed opposite an inner circumferential surface of the flexible, tubular fixing rotator at a lateral end of the flexible, tubular fixing rotator in the axial direction thereof to heat the flexible, tubular fixing rotator; and a supplementary thermal conductor contacting the flexible, tubular fixing rotator and the lateral end heater, wherein the nip formation pad includes a nip formation face contacting the supplementary thermal conductor, wherein the lateral end heater includes a fixing rotator side face disposed opposite the inner circumferential surface of the flexible, tubular fixing rotator, the fixing rotator side face of the lateral end heater being formed along a same plane as the nip formation face of the nip formation pad in a pressurization direction in which the nip formation pad presses against the opposed rotator, wherein an entirety of the nip formation pad is provided within a recess of the supplementary thermal conductor, and wherein the fixing heater and the lateral end heater are separated in the pressurization direction in which the nip formation pad presses against the opposed rotator.

2. The fixing device according to claim 1, wherein the supplementary thermal conductor covers the fixing rotator side face of the lateral end heater.

3. The fixing device according to claim 2, wherein the supplementary thermal conductor includes a contact face contacting the inner circumferential surface of the flexible, tubular fixing rotator and substantially being leveled with the nip formation face of the nip formation pad in a pressurization direction in which the nip formation pad presses against the opposed rotator.

4. The fixing device according to claim 1, further comprising:

another lateral end heater mounted on the nip formation pad and disposed opposite the inner circumferential surface of the flexible, tubular fixing rotator at another lateral end of the flexible, tubular fixing rotator in the axial direction thereof to heat the flexible, tubular fixing rotator, the another lateral end heater contacting the supplementary thermal conductor, wherein the lateral end heater, the nip formation face of the nip formation pad, and the another lateral end heater are aligned in this order in the axial direction of the flexible, tubular fixing rotator.

5. The fixing device according to claim 4, wherein the lateral end heater and the another lateral end heater are electrically connected in series.

6. The fixing device according to claim 1, wherein the fixing rotator side face of the lateral end heater defines an extension of the nip formation face of the nip formation pad.

7. The fixing device according to claim 1, wherein the supplementary thermal conductor covers the fixing rotator side face of the lateral end heater and the nip formation face of the nip formation pad along an entire length of the axial direction of the flexible, tubular fixing rotator.

8. The fixing device according to claim 1, further comprising a slide sheet sandwiched between the flexible, tubular fixing rotator and the supplementary thermal conductor.

9. The fixing device according to claim 1, wherein at least a part of a heating span of the lateral end heater in the axial direction of the flexible, tubular fixing rotator overlaps an outboard part of a heating span of the fixing heater in the axial direction of the flexible, tubular fixing rotator.

10. The fixing device according to claim 9, wherein the outboard part of the heating span of the fixing heater in the axial direction of the flexible, tubular fixing rotator includes a decreased heat output part where the fixing heater generates a decreased amount of heat.

11. The fixing device according to claim 1, wherein the lateral end heater and the supplementary thermal conductor are coupled with the nip formation pad.

12. The fixing device according to claim 1, wherein the lateral end heater has a positive temperature coefficient property.

13. The fixing device according to claim 1, wherein the nip formation pad includes a recess mounting the lateral end heater.

14. The fixing device according to claim 13, wherein the recess is open at a lateral edge of the nip formation pad in the axial direction of the flexible, tubular fixing rotator.

15. The fixing device according to claim 1, wherein the fixing heater includes a halogen heater.

16. The fixing device according to claim 1, wherein the flexible, tubular fixing rotator includes an endless belt.

17. An image forming apparatus comprising:

an image bearer to bear a toner image; and a fixing device disposed downstream from the image bearer in a recording medium conveyance direction to fix the toner image on a recording medium, the fixing device including:

a fixing rotator, which is flexible and tubular, the flexible, tubular fixing rotator being rotatable in a predetermined direction of rotation;

an opposed rotator disposed opposite the flexible, tubular fixing rotator;

a nip formation pad to press against the opposed rotator via the flexible, tubular fixing rotator to form a fixing nip between the flexible, tubular fixing rotator and the opposed rotator, the fixing nip through which the recording medium bearing the toner image is conveyed;

a fixing heater disposed opposite at least a conveyance span of the flexible, tubular fixing rotator in an axial direction thereof where the recording medium is conveyed to be heated by the flexible, tubular fixing rotator;

a lateral end heater mounted on the nip formation pad and disposed opposite an inner circumferential surface of the flexible, tubular fixing rotator at a lateral end of the flexible, tubular fixing rotator in the axial direction thereof to heat the flexible, tubular fixing rotator; and a supplementary thermal conductor contacting the flexible, tubular fixing rotator and the lateral end heater; and an electric circuit to selectively energize the fixing heater and the lateral end heater, wherein the nip formation pad includes a nip formation face contacting the supplementary thermal conductor, wherein the lateral end heater includes a fixing rotator side face disposed opposite the inner circumferential surface of the flexible, tubular fixing rotator, the fixing rotator side face of the lateral end heater being formed along a same plane as the nip formation face of the nip formation pad in a pressurization direction in which the nip formation pad presses against the opposed rotator, wherein an entirety of the nip formation pad is provided within a recess of the supplementary thermal conductor, and wherein the fixing heater and the lateral end heater are separated in the pressurization direction in which the nip formation pad presses against the opposed rotator.

18. The image forming apparatus according to claim 17, wherein the electric circuit includes:

a first switch to energize the fixing heater; and a second switch to energize the lateral end heater separately from the fixing heater.

19. The image forming apparatus according to claim 17, further comprising:

a temperature sensor to detect a temperature of the flexible, tubular fixing rotator; and a controller, operatively connected to the temperature sensor, the fixing heater, and the lateral end heater, to control the fixing heater and the lateral end heater based on the temperature of the flexible, tubular fixing rotator detected by the temperature sensor.

* * * * *